US007040129B2

(12) United States Patent
Koyama et al.

(10) Patent No.: US 7,040,129 B2
(45) Date of Patent: May 9, 2006

(54) SHEET WORKING METHOD, SHEET WORKING SYSTEM, AND VARIOUS DEVICES RELATED TO SUCH SYSTEM

(75) Inventors: Junichi Koyama, Kanagawa (JP); Hitoshi Omata, Kanagawa (JP); Osamu Hayama, Kanagawa (JP); Kazunari Imai, Kanagawa (JP); Tokuro Takehara, Kanagawa (JP); Tetsuya Anzai, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 237 days.

(21) Appl. No.: 10/169,743

(22) PCT Filed: Jan. 16, 2001

(86) PCT No.: PCT/JP01/00220

§ 371 (c)(1),
(2), (4) Date: Jul. 17, 2002

(87) PCT Pub. No.: WO01/53017

PCT Pub. Date: Jul. 26, 2001

(65) Prior Publication Data

US 2003/0015011 A1 Jan. 23, 2003

(30) Foreign Application Priority Data

Jan. 17, 2000 (JP) ..... P2000-008283
Aug. 12, 2000 (JP) ..... P2000-374838

(51) Int. Cl.

| | |
|---|---|
| ***G06F 15/46*** | (2006.01) |
| ***B21D 28/00*** | (2006.01) |
| ***B30B 15/00*** | (2006.01) |
| ***G01B 21/08*** | (2006.01) |
| ***B21C 51/00*** | (2006.01) |

(52) U.S. Cl. ..... 72/31.11; 72/20.1; 72/20.2; 72/389.3

(58) Field of Classification Search ..... 72/20.1, 72/20.2, 31.1, 31.11, 389.3, 702
See application file for complete search history.

(56) References Cited

U.S. PATENT DOCUMENTS 4,550,586 A * 11/1985 Aubert et al. ..... 72/389.3

(Continued)

FOREIGN PATENT DOCUMENTS

JP 2-30327 1/1990

(Continued)

OTHER PUBLICATIONS

English Language Abstract of JP 2891363.

(Continued)

*Primary Examiner*—David Jones
(74) *Attorney, Agent, or Firm*—Greenblum & Bernstein, P.L.C.

(57) ABSTRACT

An actual plate thickness and actual material constants are measured during punching before bending. The measured information is reflected on the bending, so that the bending is performed efficiently and accurately. Punching is carried out for each blank developed based on a nominal plate thickness and nominal material constants in blanking before the bending of a work W. Then, an actual plate thickness distribution and an actual material constant distribution of the work W are calculated based on various data containing a ram stroke and a pressure detected in the punching.

14 Claims, 17 Drawing Sheets

U.S. PATENT DOCUMENTS

| | | | | |
|---|---|---|---|---|
| 4,819,467 | A * | 4/1989 | Graf et al. | 72/20.1 |
| 5,813,263 | A * | 9/1998 | Tokai | 72/21.4 |
| 5,842,366 | A * | 12/1998 | Klingel et al. | 72/31.1 |
| 6,539,763 | B1 * | 4/2003 | Chebbi | 72/31.1 |
| 6,581,427 | B1 * | 6/2003 | Gerritsen | 72/31.11 |
| 6,708,541 | B1 * | 3/2004 | Matsumoto et al. | 72/31.1 |
| 6,796,155 | B1 * | 9/2004 | Koyama et al. | 72/31.11 |

FOREIGN PATENT DOCUMENTS

| | | |
|---|---|---|
| JP | 2508011 | 5/1996 |
| JP | 2891363 | 2/1999 |

OTHER PUBLICATIONS

English Language Abstract of-JP 2-30327.

* cited by examiner

MEASUREMENT RESULT OF PLATE THICKNESS DISTRIBUTION (EXAMPLE)

FIG.13

| BLANK | PLATE THICKNESS | TENSILE STRENGTH | ANGLE | ELONGATION | ALLOWABLE RANGE OK ? |
|---|---|---|---|---|---|
| A | $t_1$ | $X_1$ | $\theta_1$ | $l_1$ | NO |
| B | $t_2$ | $X_2$ | $\theta_2$ | $l_2$ | OK |
| C | $t_3$ | $X_3$ | $\theta_3$ | $l_3$ | NO |
| D | $t_4$ | $X_4$ | $\theta_4$ | $l_4$ | OK |
| ⋮ | ⋮ | ⋮ | ⋮ | ⋮ | ⋮ |
| | $t_n$ | $X_n$ | $\theta_n$ | $l_n$ | |

FIG.25

| PRODUCT No. | ROLLING DIRECTION TENSILE STRENGTH EQUIVALENT VALUE | PERPENDICULAR DIRECTION TENSILE STRENGTH EQUIVALENT VALUE | PLATE THICKNESS |
|---|---|---|---|
| BLANK A | | | |
| BLANK B | | | |
| | | | |

| DIE CONDITION | PUNCH TIP RADIUS | DIE SHOULDER RADIUS | DIE V GROOVE WIDTH |
|---|---|---|---|
| | | | |

SHEET WORKING METHOD, SHEET WORKING SYSTEM, AND VARIOUS DEVICES RELATED TO SUCH SYSTEM

TECHNICAL FIELD

The present invention relates to a method and a system for processing a plate material, and various devices concerning the system, and further relates to a method for calculating material attributes.

BACKGROUND ART

Conventionally, in the system for processing a plate material, a nominal value of a work, for example a material of SPCC, and a plate thickness of 1.6, is entered to an automatic programming machine. Based on this nominal value, an elongation value necessary for bending is calculated, and a developed dimension of a blank is calculated from this elongation value.

In blanking work before bending, punching of the blanks is carried out by a punching machine based on the developed dimension. Each blank is bent by a bending machine.

In the conventional system for processing a plate material, if a characteristic of a work to be actually processed is far from a nominal value, for example if an actual plate thickness is 1.5 mm while a nominal plate thickness is 1.6 mm, a correct developed length of the blank cannot be obtained at the automatic programming machine based on an elongation value generated by such a difference in plate thickness. Consequently, a problem has been inherent, i.e., an actual bent dimension after bending is not within an allowable range.

At some bending machines, a plate thickness of the work is measured by a plate thickness detecting function during bending of the work, and this measured plate thickness is applied to determination of a D value (stroke amount of a ram) for setting a bending angel. However, plate thickness information actually measured was simply used at a single bending machine. For example, a problem has been inherent, i.e., even if a plate thickness of the blank is measured by the plate thickness detecting function during bending, the developed dimension of the blank that has been punched cannot be corrected. Alternatively, a problem has occurred, i.e., correction of the blank necessitates time and labor of reprocessing.

The work has a plate thickness changed from place to place even on a sheet. Consequently, since a difference is generated in plate thickness of each blank, as described above, a problem has been inherent, i.e., a bent dimension is not within an allowable range.

Regarding the bending angle, it is known that the bending angle closer to an actual angle is obtained by calculating a spring-back amount or a stroke amount based on the actual plate thickness and the actual material constant rather than a nominal plate thickness and a nominal material constant (tensile strength, Young's modulus, an n value, an f value, or the like). However, unless the actual plate thickness or the actual material constant of the work is known before bending, it cannot be reflected on the developed dimension. Even if the material constant can be calculated from load/stroke information during first bending, this information is reflected from next bending.

The present invention was made to solve the foregoing problems. Objects of the invention are to provide a method for calculating material attributes, and a method and a system for processing a plate material, which enable bending work to be carried out efficiently and accurately by measuring the actual plate thickness and the actual material constant during punching before bending, and reflecting the measured information in the bending.

DISCLOSURE OF THE INVENTION

According to an aspect of the present invention, a method is provided for processing a plate material. The method includes punching a work into multiple blanks, based on a nominal plate thickness and a nominal material constant of the work, while detecting a ram stroke and a pressure at each punching of the work into blanks. The method also includes calculating an actual plate-thickness distribution and an actual material-constant distribution of the work, based on data of the ram strokes and the pressures detected in the punching of the work into blanks. The method further includes determining an actual plate thickness and an actual material constant of each blank based on the actual plate-thickness distribution and the actual material-constant distribution of the work.

According to another aspect of the present invention, the method includes bending each blank, based on the determined actual plate thicknesses and actual material constants.

According to still another aspect of the present invention, in the bending of each blank, an elongation value of the blank is calculated based on the determined actual plate thickness and the actual material constant of the blank being bent. A determination is made as to whether a difference between the calculated elongation value and a nominal elongation value, obtained based on a nominal plate thickness and a nominal material constant of the work, is within an allowable range. When the difference is within the allowable range, the bending is based on the actual plate thickness and the actual material constant. When the difference is outside the allowable range, the bending is stopped or a significant part is subjected to bending based on the actual plate thickness and the actual material constant.

According to an aspect of the present invention, a method is provided for processing a plate material prior to punching a work into multiple blanks. The method includes trial-punching in gaps between adjoining blanks, based on a nominal plate thickness and a nominal material constant of the work, while detecting a ram stroke and a pressure at each trial-punching in the gaps. The method also includes calculating an actual plate-thickness distribution and an actual material-constant distribution of the work, based on data of the ram strokes and the pressures detected in the trial-punching. The method further includes determining an actual plate thickness and an actual material constant of each blank based on the actual plate-thickness distribution and the actual material-constant distribution of the work. The method additionally includes blanking each blank by punching the work into the multiple blanks, based on the determined actual plate thicknesses and actual material constants. The method also includes bending each blank, based on the determined actual plate thicknesses and actual material constants.

According to another aspect of the present invention, in the blanking of each blank, an elongation value of the blank is calculated based on the determined actual plate thickness and actual material constant of the blank being blanked. A determination is made as to whether a difference between the calculated elongation value and an average elongation value, based upon an average blank having an average plate thickness and average material constant, is within an allowable range. When the difference is within the allowable range, the blank is subjected to blanking based on the average plate thickness and the average material constant. When the difference is outside the allowable range, the blanking is stopped or the blank is subjected to blanking based on the actual plate thickness and the actual material constant.

According to still another aspect of the present invention, the bending of each blank includes calculating an average stroke amount for an average blank, having an average plate thickness and average material constant, that is bent by a predetermined angle. A determination is made as to whether a bend angle is within an allowable range of the predetermined angle when another blank is bent by the calculated stroke amount. When the bend angle is within the allowable range, the blank is subjected to bending by the calculated stroke amount. When the bend angle is outside the allowable range, the bending is stopped or the blank is subjected to bending by another stroke amount calculated based on the actual plate thickness and the actual material constant.

According to another aspect of the present invention, the bending of each blank includes calculating an average pinching-in angle for an average blank having an average plate thickness and average material constant by obtaining a spring-back amount for the average blank. A determination is made as to whether a finishing angle is within an allowable range when another blank is bent by the calculated pinching-in angle. When the finishing angle is within the allowable range, the blank is subjected to bending by the calculated pinching-in angle. When the finishing angle is outside the allowable range, the obtained spring-back amount is utilized to calculate another pinching-in angle based on the actual plate thickness and the actual material constant, and bending is carried out using the other calculated pinching-in angle.

A system is provided for processing a plate material. The system includes an automatic programming machine that calculates an expanded dimension of a blank, based on a nominal plate thickness and a nominal material constant of a work to be processed. The system also includes a punching machine that punches the work into multiple blanks by cooperation of a punch with a die while detecting a ram stroke and a pressure at each punching of the work into blanks. The system also includes a control unit including a plate thickness/material constant arithmetic unit that calculates an actual plate-thickness distribution and an actual material-constant distribution of the work based on data of the ram strokes and the pressures detected in the punching of the work into blanks, and that determines an actual plate thickness and an actual material constant of each blank based on the actual plate-thickness distribution and the actual material-constant distribution of the work. The system further includes a bending machine that bends each blank, based on the determined actual plate thickness and the actual material constant of the blank being bent.

According to another aspect of the present invention, the control unit includes an elongation error determiner that determines whether a difference between an elongation value of each blank, calculated based on the determined actual plate thickness and the actual material constant of the blank being bent, and a nominal elongation value, obtained based on a nominal plate thickness and nominal material constant of the work, is within an allowable range.

According to another aspect of the present invention, the control unit includes an elongation error determiner that determines whether a difference between an elongation value of each blank, calculated based on the determined actual plate thickness and the actual material constant of the blank being bent, and an average elongation value, based upon an average blank having an average plate thickness and average material constant, is within an allowable range.

According to still another aspect of the present invention, the control unit includes a stroke control bending error calculator that calculates an average stroke amount for an average blank having an average plate thickness and average material constant, and that determines whether a bend angle is within an allowable range of a predetermined angle when another blank is bent by the calculated stroke amount.

According to another aspect of the present invention, the control unit includes a pinching-in angle control bending error determiner that calculates a pinching-in angle by obtaining an average spring-back amount for an average blank having an average plate thickness and average material constant, and that determines whether a finishing angle is within an allowable range when another blank is bent by the calculated pinching-in angle.

According to still another aspect of the present invention, the bending of each blank includes calculating an average stroke amount for an average blank, having an average plate thickness and average material constant, that is bent by a predetermined angle. A determination is made as to whether a bend angle is within an allowable range of the predetermined angle when another blank is bent by the calculated stroke amount. When the bend angle is within the allowable range, the blank is subjected to bending by the calculated stroke amount. When the bend angle is outside the allowable range, the bending is stopped or the blank is subjected to bending by another stroke amount calculated based on the actual plate thickness and the actual material constant.

According to still another aspect of the present invention, the bending of each blank includes calculating an average pinching-in angle for an average blank, having an average plate thickness and average material constant, by obtaining a spring-back amount for the average blank. A determination is made as to whether a finishing angle is within an allowable range when another blank is bent by the calculated pinching-in angle. When the finishing angle is within the allowable range, the blank is subjected to bending by the calculated pinching-in angle. When the finishing angle is outside the allowable range, the obtained spring-back amount is utilized to calculate another pinching-in angle based on the actual plate thickness and the actual material constant of the blank being bent, and bending is carried out using the other calculated pinching-in angle.

In order to achieve the foregoing object, a method for calculating a material attribute includes the steps of: punching each of the blanks developed based on a nominal plate thickness and nominal material constants of a work in a blanking process before bending of the work; calculating an actual plate thickness distribution and an actual material constant distribution of the work based on various data containing a ram stroke and a pressure detected during the punching step; and deciding an actual plate thickness and actual material constants of each of the blanks based on the plate thickness distribution and the material constant distribution.

Thus, the actual plate thickness and the actual material constants of each blank can be efficiently and accurately measured during punching in blanking before bending. Therefore, this measured information can be reflected on bending, and efficient and accurate bending can be carried out.

According to the present invention, a method for processing a plate material includes the steps of: punching each of the blanks developed based on a nominal plate thickness and nominal material constants of a work in blanking before bending of the work; calculating an actual plate thickness distribution and an actual material constant distribution of the work based on various data containing a ram stroke and a pressure detected during the punching; deciding an actual plate thickness and actual material constants of each blank based on the plate thickness distribution and the material constant distribution; and bending each of the blanks based on the actual plate thickness and the actual material constants.

Thus, the actual plate thickness and the actual material constants of each blank can be measured during punching in blanking before bending. Therefore, this measured information can be reflected on bending, and efficient and accurate bending can be carried out. Moreover, for example, a block of blanks having small bending errors simplifies work in inspection time. Thus, the inspection time after bending can be shortened.

According to the present invention, in the method for processing a plate material, in the bending of each of the blanks, an elongation value of each of the blanks is calculated based on the actual plate thickness and the actual material constants thereof, determination is made as to whether a difference between this elongation value and an elongation value obtained based on the nominal plate thickness and the nominal material constants of the work is within an allowable range or not, the blank having the difference within the allowable range is subjected to bending based on the actual plate thickness and the actual material constants, and for the blank having the difference outside the allowable range, a significant dimension part thereof is preferentially subjected to bending based on the actual plate thickness and the actual material constants, or the bending is stopped.

Thus, an elongation error of each blank can be measured beforehand. Therefore, since bending along an actual situation can be carried out depending on whether the elongation error is within the allowable range or not, it is possible to improve product accuracy and work efficiency after bending, and shorten the inspection time after bending.

According to the present invention, a method for processing a plate material includes the steps of: executing trial-punching on a gap between blanks developed based on a nominal plate thickness and nominal material constants of a work in a blanking process before bending of the work; calculating an actual plate thickness distribution and an actual material constant distribution of the work based on various data containing a ram stroke and a pressure detected during the trial-punching; deciding an actual plate thickness and actual material constants of each of the blanks blank based on the plate thickness distribution and the material constant distribution; developing each of the blanks and executing blanking based on the actual plate thickness and the actual material constants; and bending each of the blanks based on the actual plate thickness and the actual material constants.

Thus, since the actual plate thickness distribution and the material constant distribution of the work can be measured during trial-punching before bending, an actual plate thickness and actual material constants of each blank can be decided. Since this measured information can be reflected on accurate development and blanking of each blank and also reflected on bending, efficient and accurate bending can be carried out. Moreover, for example since a block of blanks having small bending errors simplifies work in the inspection time, it is possible to shorten the inspection time after bending.

According to the present invention, in the method for processing a plate material, in the blanking of each of the blanks, an elongation value of each of the blanks is calculated based on the actual plate thickness and the actual material constants thereof, determination is made as to whether a difference between this elongation value and an average elongation value obtained from the blank having an average plate thickness and average material constants among the blanks is within an allowable range or not, the blank having the difference within the allowable range is developed and subjected to blanking based on the average plate thickness and the average material constants, and the blank having the difference outside the allowable range is developed and subjected to blanking based on the actual plate thickness and the actual material constants or the blanking thereof is stopped.

Thus, since an elongation error of each blank can be calculated beforehand, blanking and bending along an actual situation can be carried out depending on whether the elongation error is within the allowable range or not. Therefore, it is possible to improve product accuracy and work efficiency during bending, and shorten the inspection time after bending.

According to the present invention, in the method for processing a plate material, in the bending of each of the blanks, an stroke amount when the blank having an average plate thickness and average material constants among the blanks is bent by a predetermined angle is calculated, determination is made as to whether an angle when another blank is bent by the same stroke amount is within an allowable range or not with respect to the predetermined angle, the blank having the angle within the allowable range is subjected to bending by the same stroke amount, and the blank outside the allowable range is subjected to bending by a stroke amount calculated based on plate thickness and material constants thereof or the bending step is stopped.

Thus, since a bending error under control of the stroke amount of each blank can be calculated beforehand, blanking and bending along an actual situation can be carried out depending on whether the bending error is within the allowable range or not. Therefore, product accuracy and work efficiency during bending are improved, and the inspection time after bending is shortened.

According to the present invention, in the method for processing a plate material, in the bending of each blank, a pinching-in angle is calculated by obtaining a spring-back amount of the blank having the average plate thickness and the average material constants among the blanks, determination is made as to whether a finishing angle after another blank is bent by the same pinching-in angle is within an allowable range or not, the blank having the finishing angle within the allowable range is subjected to bending by the same pinching-in angle, for the blank having the finishing angle outside the allowable range, the spring-back amount is obtained to calculate the pinching-in angle based on the plate thickness and the material constants thereof, and bending is carried out by the pinching-in angle.

Thus, a bending error under control of the pinching-in angle of each blank can be calculated beforehand. Therefore, since blanking and bending along an actual situation can be carried out depending on whether the bending error is within the allowable range or not, product accuracy and work efficiency during bending are improved, and the inspection time after bending is shortened.

According to the present invention, a system for processing a plate material includes: an automatic programming machine for developing blanks based on a plate thickness and material constants of a work; a punching machine for punching and blanking the work by cooperation between a punch and a die; a control unit including a plate thickness/material constant arithmetic unit for calculating an actual plate thickness distribution and an actual material constant distribution based on various data containing a ram stroke and a pressure detected during the punching of the work by the punching machine, and deciding an actual plate thickness and actual material constants of each of the blanks from the calculated plate thickness distribution and material constant distribution; and a bending machine for bending each of the blanks based on the actual plate thickness and the actual material constants thereof.

Thus, since the actual plate thickness distribution and the material constant distribution of the work can be measured during punching before bending, the actual plate thickness and the actual material constants of each blank can be decided. Since this measured information can be reflected on accurate development and blanking of each blank and also reflected on bending, efficient and accurate bending can be carried out. Moreover, for example since a block of blanks having small bending errors simplifies work in the inspection time, the inspection time after bending is shortened.

According to the present invention, in the system for processing a plate material, the control unit includes elongation error determining means for determining whether a difference between an elongation value of each of the blanks calculated based on the actual plate thickness and the actual material constants of each of the blanks and an elongation value obtained from a nominal plate thickness and nominal material constants of a work is within an allowable range or not.

Thus, since the elongation error of each blank can be calculated beforehand, bending along an actual situation can be carried out depending on whether the elongation error is within the allowable range or not. Therefore, product accuracy and work efficiency during bending are improved, and the inspection time after bending is shortened.

According to the present invention, in the system for processing a plate material, the control unit includes elongation error determining means for determining whether a difference between an elongation value of each of the blanks obtained based on the actual plate thickness and the actual material constants thereof and an average elongation value obtained from the blank having an average plate thickness and average material constants among the blanks is within an allowable range or not.

Thus, since the elongation error of each blank can be calculated beforehand, blanking and bending along an actual situation can be carried out depending on whether the elongation error is within the allowable range or not. Therefore, product accuracy and work efficiency during bending are improved, and the inspection time after bending is shortened.

According to the present invention, in the system for processing a plate material, the control unit includes stroke control bending error determining means for calculating a stroke amount when the blank having an average plate thickness and average material constants among the blanks based on the actual plate thickness and the actual material constants, and determining whether an angle when another blank is bent by the same stroke amount is within an allowable range or not with respect to a predetermined angle.

Thus, since a bending error under control of the stroke amount of each blank can be calculated beforehand, blanking and bending along an actual situation can be carried out depending on whether the bending error is within the allowable range or not. Therefore, product accuracy and work efficiency during bending are improved, and the inspection time after bending is shortened.

According to the present invention, in the system for processing a plate material, the control unit includes pinching-in angle control bending error determining means for calculating a pinching-in angle by obtaining a spring-back amount of the blank having an average plate thickness and an average material constants among the blanks, and determining whether a finishing angle after another blank is bent by the same pinching-in angle is within an allowable range or not.

Thus, since a bending error under control of the pinching-in angle of each blank can be calculated beforehand, blanking and bending along an actual situation are carried out depending on whether the bending error is within the allowable range or not. Thus, product accuracy and work efficiency during bending are improved, and the inspection time after bending is shortened.

According to the present invention, a method for processing sheet metal includes the steps of: processing and forming a sample and a blank on a work while leaving a microjoint part in a blanking process; detecting at least one of a plate thickness of the work in an optional position and a spring-back amount during bending of the sample; transmitting information of at least one of the plate thickness and the spring-back amount to a control unit of a bending machine in a bending process after the blanking process; and carrying out bending by calculating a ram control value in bending by using data of at least one of the transmitted plate thickness and spring-back amount, and other bending data.

Thus, in a blank processing step such as punching or laser cutting before the bending step, at least one of the plate thickness and the spring-back amount of the work is detected as quantitative data of a material characteristic necessary for bending simultaneously with blank processing. Since at least one of the plate thickness and the spring-back amount of the work is incorporated as a control parameter in bending control at a stage of bending using a press brake, it is possible to obtain a bent product having a target bending angle from first processing without carrying out trial bending.

According to the present invention, a system for processing sheet metal includes: a blank processing machine capable of processing and forming a sample and a blank on a work while leaving a microjoint part, the blank processing machine including a work characteristic detection unit for detecting at least one of a plate thickness of the work in an optional position and a spring-back amount during bending of the sample in bending; and a bending machine for carrying out bending by calculating a ram control value in bending by using at least one data of the plate thickness and the spring-back amount of the work and the spring-back amount detected by the work characteristic detection unit provided in the blank processing machine, and other bending data.

Thus, at the blank processing step carrying out punching or laser cutting before bending, at least one of the plate thickness and the spring-back amount of a work is detected as quantitative data of a material characteristic necessary for bending simultaneously with blank processing. Therefore, since at least one of the plate thickness and the spring-back amount of the work is incorporated as a control parameter in bending control at the stage of bending using a press brake, it is possible to obtain a bent product having a target bending angle from first processing without carrying out trial bending.

According to the present invention, a blank processing machine capable of processing and forming a sample and a blank on a work while leaving a microjoint part, the blank processing machine including a work characteristic detection unit for detecting at least one of a plate thickness of the work in an optional position and a spring-back amount during bending of the sample in bending.

Thus, at the blank processing machine, at least one of the plate thickness and the spring-back amount of the work can be detected as quantitative data of a material characteristic necessary for bending simultaneously with blank processing in the step before bending. Therefore, at least one of the plate thickness and the spring-back amount of the work is used as a control parameter at the stage of bending.

According to the present invention, in the blank processing machine, the work characteristic detection unit is a work plate thickness measuring device including: a probe member provided to be freely moved up and down, the probe member being capable of bending the sample of the work in cooperation with a die; a sensor plate provided to be freely moved up and down relative to the probe member, and provided to be always pressed downward to be protruded downward by a predetermined length from a lower end of the probe member; position detecting means for detecting a difference in relative positions of a vertical direction between the probe member and the sensor plate; and a plate thickness arithmetic unit for calculating a plate thickness of the work based on reference position information by the position detecting means when tips of the probe member and the sensor plate coincide with each other in measurement of a known reference plate thickness and measuring position information by the position detecting means when the tips of the probe member and the sensor plate coincide with each other in plate thickness measurement of the work.

Thus, a probe member is started to be lowered to a work set in a predetermined position, and first, a sensor plate is brought into contact with the work. Then, the probe member is brought into contact with the work while the sensor plate is in contact with the work. When tips of the probe member and the sensor plate coincide with each other, the measuring position information is detected by the position detecting means. The reference position information is detected by the position detecting means when the tips of the probe and the sensor plate coincide with each other in previous measurement of a known reference plate thickness. Accordingly, the plate thickness of each of the sample and the blank is calculated based on a difference between the measured position information and the reference position information.

According to the present invention, in the blank processing machine, the work characteristic detection unit is a spring-back arithmetic unit including: a probe member provided to be freely moved up and down, the probe member being capable of bending the sample of the work by cooperation with a die; a sensor plate provided to be freely moved up and down relative to the probe member, and provided to be always pressed downward to be protruded downward by a predetermined length from a lower end of the probe member and freely brought into contact with both side faces inside the work during bending; position detecting means for detecting a difference in relative positions of a vertical direction between the probe member and the sensor plate; and a spring-back arithmetic unit for calculating a spring-back amount of the sample based on a difference between bending position information of the probe member and the sensor plate by the position detecting means at a predetermined stroke of the probe member and spring-back position information of the probe member and the sensor plate by the position detecting means when the probe member is separated from the sample and the sample is sprung back.

Thus, the bending position information is detected by the position detecting means when the probe member is lowered by a predetermined stroke to bend the sample. Then, the spring-back position information is detected by the position detecting means when the probe member is separated from the sample, and the sample is sprung back. The spring-back amount of the sample is calculated based on a difference between the spring-back position information and the bending position information.

According to the present invention, a work plate thickness measuring device includes: a probe member provided to be freely moved up and down, the probe member being capable of bending a sample of a work in cooperation with a die; a sensor plate provided to be freely moved up and down relative to the probe member, and provided to be always pressed downward to be protruded downward by a predetermined length from a lower end of the probe member; position detecting means for detecting a difference in relative positions of a vertical direction between the probe member and the sensor plate; and a plate thickness arithmetic unit for calculating a plate thickness of the work based on reference position information by the position detecting means when tips of the probe member and the sensor plate coincide with each other in measurement of a known reference plate thickness and measuring position information by the position detecting means when the tips of the probe member and the sensor plate coincide with each other in the plate thickness measurement of the work.

Thus, the probe member is started to be lowered to the work set in a predetermined position, and first, the sensor plate is brought into contact with the work. Then, the probe member is brought into contact with the work while the sensor plate is in contact with the work. When tips of the probe member and the sensor plate coincide with each other, the measuring position information is detected by the position detecting means. The reference position information is detected by the position detecting means when the tips of the probe and the sensor plate coincide with each other in previous measurement of a known reference plate thickness. Accordingly, the plate thickness of each of the sample and the blank is calculated based on a difference between the reference position information and the measuring position information.

According to the present invention, a spring-back measuring device includes: a probe member provided to be freely moved up and down, the probe member being capable of bending a sample of a work in cooperation with a die; a sensor plate provided to be freely moved up and down relative to the probe member, and provided to be always pressed downward to be protruded downward by a predetermined length from a lower end of the probe member and freely brought into contact with both side faces inside the work during bending; position detecting means for detecting a difference in relative positions of a vertical direction between the probe member and the sensor plate; and a spring-back arithmetic unit for calculating a spring-back amount of the sample based on a difference between bending position information of the probe member and the sensor plate by the position detecting means at predetermine stroke of the probe member, and spring-back position information of the probe member and the sensor plate by the position detecting means when the probe member is separated from the sample and the sample is sprung back.

Thus, the bending position information when the probe member is lowered by a predetermined stroke to bend the sample is detected by the position detecting means. Then, the spring-back position information is detected by the position detecting means when the probe member is separated from the sample and the sample is sprung back. The spring-back amount of the sample is calculated based on a difference between the bending position information and the bending position information.

BRIEF DESCRIPTION OF DRAWINGS

FIG. 13 is an explanatory view showing a display state of a message according to the first embodiment.

FIG. 25 is a table showing array data of a measured plate thickness, a spring-back amount $\epsilon$, a die condition used for bending, and the like.

BEST MODES FOR CARRYING OUT THE INVENTION

Next, description will be made of preferred embodiments of a method and a system for processing a plate material according to the present invention with reference to the accompanying drawings.

Figure 1:
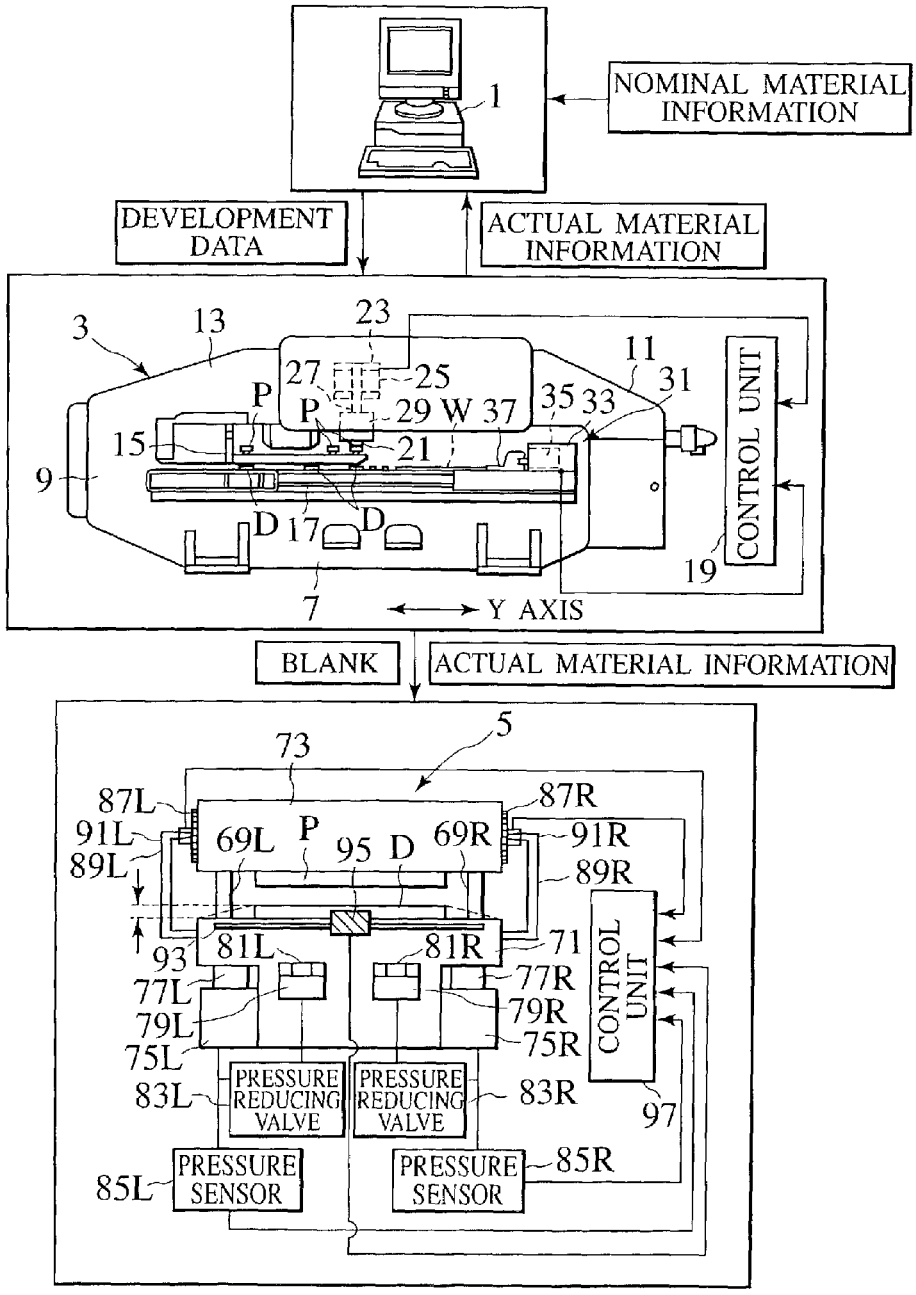
FIG. 1 is an explanatory front view schematically showing each device used in a plate material processing system according to an embodiment of the present invention.

Referring to FIG. 1, a system of an embodiment for processing a plate material includes an automatic programming machine 1 for developing blanks based on a plate thickness, and material constant (tensile strength, Young's modulus, an n value, an f value or the like) of a work W, for example a turret punch press 3 as a punching machine for punching the work W by cooperative work between a punch P and a die D for blanking, and for example a press brake 5 as a bending machine for bending each blank punched by the turret punch press 3.

More specifically, for example, the above-described turret punch press 3 as the punching machine is formed in a frame structure, where both sides of an upper frame 13 are supported on side frames 9 and 11 erected on both sides of a base 7. Below the upper frame 13, a disk-shaped upper turret 15 is rotatably loaded, which includes a variety of punches P to be freely detached and exchanged. A lower turret 17 facing the upper turret 15 is rotatably loaded on an upper surface of the base 7. This lower turret 17 includes a number of dies D facing the variety of punches P, which are disposed in a circular-arc shape and loaded to be freely detached and exchanged. The upper and lower turrets 15 and 17 are rotated in synchronization in the same direction by control of a control unit 19.

Positions of dies D and punches P loaded on the right side of the upper and lower turrets 15 and 17 in FIG. 1 are processing positions. A striker 21 is installed so as to be freely moved up and down on the upper frame 13 above the punches P located in the processing positions. This striker 21 is connected through, for example a ram 29 (punch press member), to a piston rod 27 of a piston 25 moved up and down in a hydraulic cylinder 23 as a drive unit provided in the upper frame 13.

The turret punch press 3 also includes a work movement positioning device 31 for moving the work W back and forth, and left and right and positioning the work W to the processing position. The movement positioning device 31 is provided so as to be controlled by the control unit 19. The work movement positioning device 31A includes a carriage base 33 provided on the base 7 so as to be freely moved in a Y axis direction of a left-and-right direction in FIG. 1. On this carriage base 33, a carriage 35 is provided so as to be freely moved in an X axis direction orthogonal to the Y axis substantially on a plane. The carriage 35 includes a plurality of work clamps 37 provided at proper intervals in the X axis direction to clamp the work W.

Accordingly, the punch P is struck by the ram 29, and the work W set in the processing position is subjected to punching by cooperation between the punch P and the die D.

Figure 2:
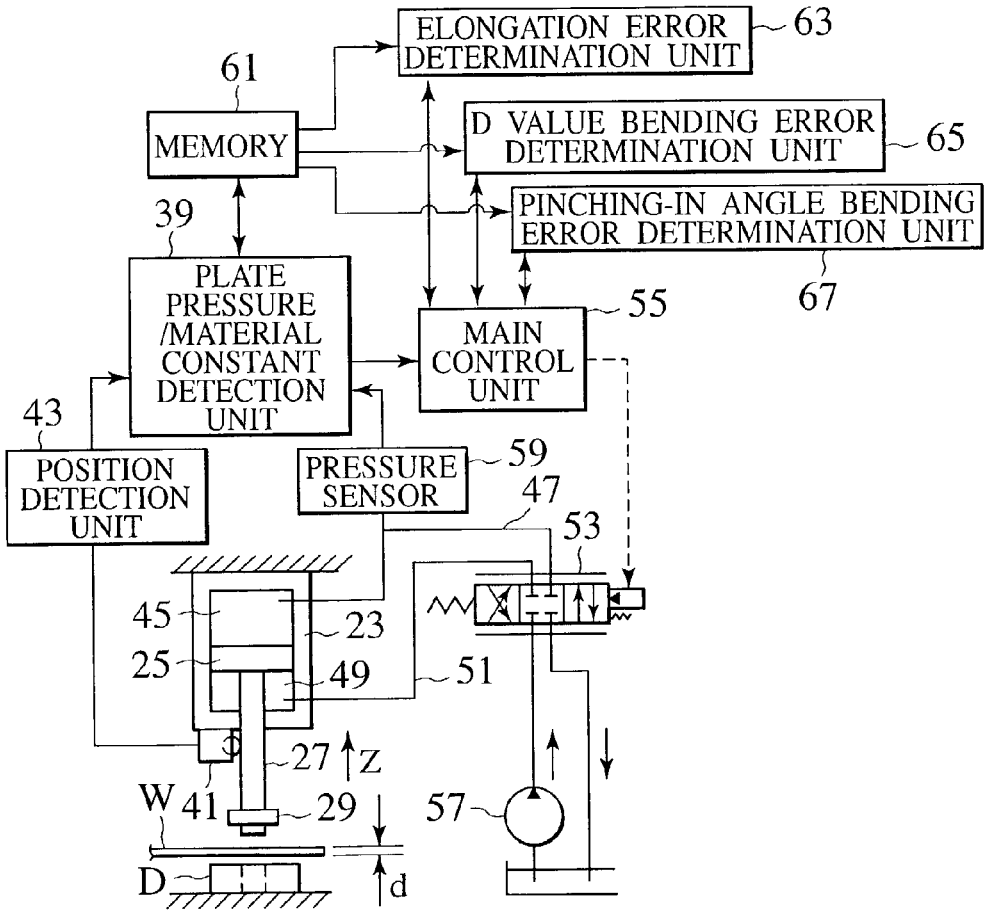
FIG. 2 is a block diagram showing a control unit of a punching machine according to the embodiment of the present invention.

As shown in FIG. 2, the control unit 19 of the turret punch press 3 includes a plate thickness/material constant arithmetic unit, for example a plate thickness/material constant detection unit 39, for calculating an actual plate thickness distribution and an actual material constant distribution of the work W based on various data containing a ram stroke and a pressure detected in punching of the work W, and deciding an actual plate thickness and actual material constants of each blank from the calculated plate thickness distribution and the calculated material constant distribution.

Referring to FIG. 2, an encoder 41 is provided below the hydraulic cylinder 23. This encoder 41 outputs a pulse signal proportional to a moving speed following an up-and-down movement of the ram 29. The pulse signal is entered to a position detection unit 43, where a lower end position of the punch P, i.e., a stoke amount of the ram 29, is detected. The stroke amount is electrically transmitted to the plate thickness/material constant detection unit 39 for detecting the plate thickness and the material constants of the work W.

A servo valve 53 is communicated through a pressure side hydraulic pipe line 47 to a pressure chamber 45 of the hydraulic cylinder 23, and is communicated through a back-pressure side hydraulic pipe line 51 to a back-pressure chamber 49. A command is issued from a main control unit 55 to switch the servo valve 53, and pressure oil of a hydraulic pump 57 is accordingly supplied to the pressure chamber 45 or the back-pressure chamber 49 of the hydraulic cylinder 23. Thus, the ram 29 is driven up and down at a predetermined speed.

A pressure sensor 59 for detecting a pressing force in punching is connected to the pressure side hydraulic pipe line 47. The pressing force detected by this pressures sensor 59 is electrically transmitted to the plate thickness/material constant detection unit 39.

Figure 3:
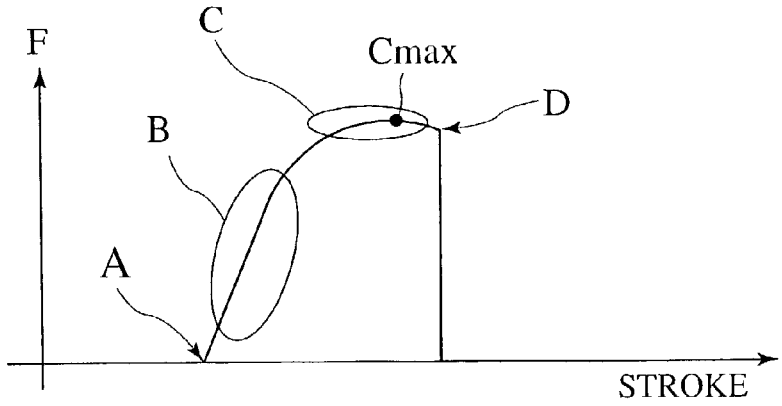
FIG. 3 is a stroke/load diagram in punching according to the embodiment of the present invention.

With the foregoing configuration, at the plate thickness/material constant detection unit 39, a stroke/load diagram as shown in FIG. 3 is obtained from the stroke amount transmitted from the position detection unit 43 and a punching load transmitted from the pressure sensor 59 in punching of the work W. In FIG. 3, a reference code B denotes an elastic deformation area, C a plastic deformation area, a Cmax a maximum punching load, and D breaking.

As shown in the stroke/load diagram, a load is suddenly increased at a position of a point A, where the punch P is brought into contact with the work W, so that the position of the point A is detected. Accordingly, the actual plate thickness is detected.

Also, the material constants are obtained from the stroke/load diagram. For example, a tensile strength is obtained from a size of the maximum punching load Cmax. Alternatively, Yung's modulus E is obtained from inclination of the elastic deformation area B, and yield stress σ, an N value, an F value, a maximum tensile stress value and the like are obtained from the plastic deformation area C.

More specifically, the material constants in punching cannot be directly used for calculation in bending. However, since the stroke/load diagrams of similar shapes are obtained in the cases of punching and applying tension using the same material, the material constants obtained from the stroke/load diagram of punching can be converted into the material constants in the case of applying tension.

For example, it is assumed that the material constants calculated from the stroke-load diagram obtained from a tensile test of a reference material are Young's modulus E0T, Poisson's ratio ν0T, yield stress σ0T, an N value n0T, and an F value f0T. These material constants in the tension application are stored beforehand in a memory 61 of the control unit 19 of the turret punch press 3.

It is assumed that the material constants calculated from the stroke/load diagram obtained by punching the reference material with a reference die for material constant detection as described above are Young's modulus E0P, Poisson's ratio νoP, yield stress σ0P, an N value n0P, and an F value f0P. These material constants in punching are also stored beforehand in the memory 61 of the control unit 19 of the turret punch press 3.

Assuming that the material constants calculated from the stroke/load diagram obtained by punching the actually used work W with the reference die for material constant detection as described above are Young's modulus E1P, Poisson's ratio ν1P, yield stress σ1P, an N value n1P, and an F value f1P, the material constants in tension application of the actually used work W are converted into Young's modulus E1T [=(E1P/E0P)E0T], Poisson's ratio ν1T [=(ν1P/ν0P)ν0T], yield stress σ1T [=(σ1P/σ0P)σ0T], an N value n1T [=(n1P/n0P)n0T], and an F value f1T [=(f1P/f0P)f0T].

Referring back to FIG. 2, the control unit 19 of the turret punch press 3 includes the memory 61 for storing data from the automatic programming machine 1, and data of the stroke/load diagram or the plate thickness distribution and the material constant distribution obtained by the plate thickness/material constant detection unit 39.

Further, the control unit 19 includes error determining means, for example, an elongation error determination unit 63, for determining whether a difference between an elongation value of each blank calculated based on the actual plate thickness and material constants of each blank decided by the plate thickness/material constant detection unit 39, and an elongation value obtained from the nominal plate thickness and the nominal material constants of the work W is within an allowable range or not.

At the elongation error determination unit 63, determination can also be made as to whether a difference between the elongation value of each blank calculated based on the actual plate thickness and material constants of each blank decided by the plate thickness/material constant detection unit 39, and an average elongation value obtained from the blank having the average plate thickness and the average material constants among the banks is within an allowable range or not.

The control unit 19 includes stroke control bending error determining means, for example, a D value bending error determination unit 65, for calculating a stroke amount when the blank having the average plate thickness and the average material constants is bent by a predetermined angle among the blanks based on the actual plate thickness and the actual material constants, and determining whether an angle when another blank is bent by the same stroke amount is within an allowable range or not with respect to a predetermined angle.

The control unit 19 includes pinching-in angle control bending error determining means, for example, a pinching-in angle bending error determination unit 67, for calculating a pinching-in angle by obtaining a spring-back amount of the blank having the average plate thickness and material constants among the blanks, and determining whether a finishing angle after the other blank is bent to the same pinching-in angle is within an allowable range or not.

Referring back to FIG. 1, the bending machine, for example the press brake 5, includes erected C frames 69L and 69R. A lower table 71 is provided at the lower front face of the C frames 69L and 69R so as to be moved up and down. A die D is detachably loaded on the lower table 71. On the other hand, an upper table 73 is fixed on the upper front face of the C frame 69. On the lower portion of this upper table 73, a punch P is detachably loaded.

Main cylinders 75L and 75R are provided below the C frame 69. Tips (upper ends) of piston rods 77L and 77R loaded on the main cylinders 75L and 75R are attached to the lower table 71. Crowning sub-cylinders 79L and 79R are incorporated in the lower table 71 and attached through piston rods 81L and 81R to an upper portion of the lower table 71.

Pressure reducing valves 83L and 83R are respectively connected to the main cylinder 75L and the sub-cylinder 79L, and to the main cylinder 75R and the sub-cylinder 79R. Pressure sensors 85L and 85R are respectively connected to the main cylinders 75L and 75R. Position scales 87L and 87R are provided on both side faces of the upper table 73. Position sensors 91L and 91R are provided through brackets 89L and 89R on both side faces of the lower table 71.

Further, a guide rail 93 is laid on the upper front face of the lower table 71. On this guide rail 93, a bending angle measuring device 95 for detecting a bending angle when the work W is bent is provided so as to be moved left and right.

The bending angle measuring device 95, the pressure sensors 85L and 85R, and the position sensors 91L and 91R are respectively connected to the control unit 97.

Figure 4:
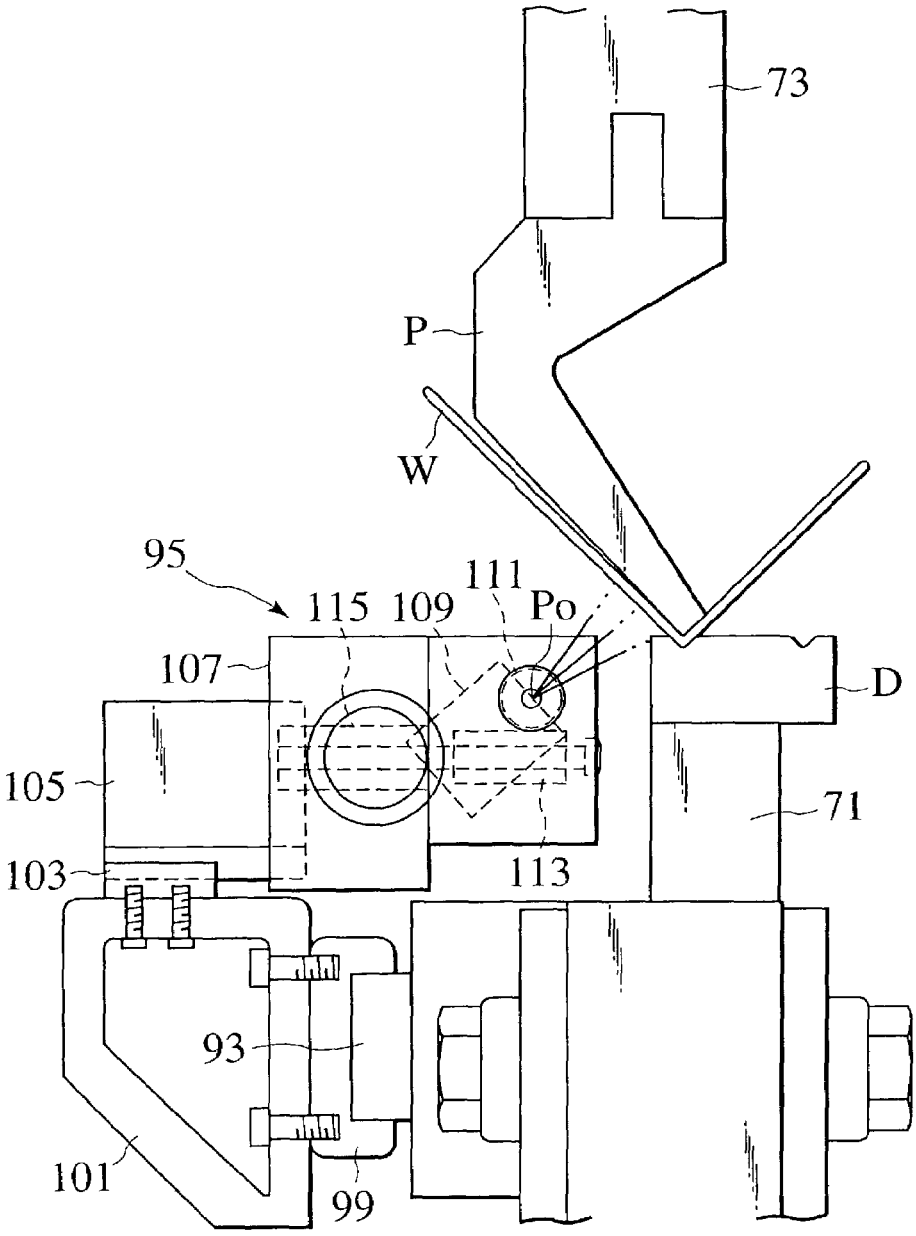
FIG. 4 is an expanded side view showing a measurement indicator portion of a bending machine shown in FIG. 1 according to the embodiment of the present invention.

Referring to FIG. 4, on the guide rail 93, a slider 99 is provided so as to be freely moved and positioned in a direction orthogonal to a paper surface of FIG. 4. A bracket 101 is attached to the slider 99 by a plurality of bolts. A guide rail 103 is provided back and forth (left and right in FIG. 4) on the bracket 101. A slider 105 is provided so as to be moved back and forth along the guide rail 103. A measurement indicator 107 is provided on the slider 105.

The measurement indicator 107 includes a detection head 109, which is supported so as to be rotated integrally with a gear 111 having a rotational center P0 on the front center of the detection head 109. In addition, a worm gear 113 to be engaged with the gear 111 is rotatably provided. The worm gear 113 is rotary-driven by a motor 115.

Thus, when the motor 115 rotates the worm gear 113, the gear 111 engaged with the worm gear 113 is rotary-driven. Accordingly, the detection head 109 is swung up and down (up-and-down direction in FIG. 4) by a desired angle around the front center.

Figure 5:
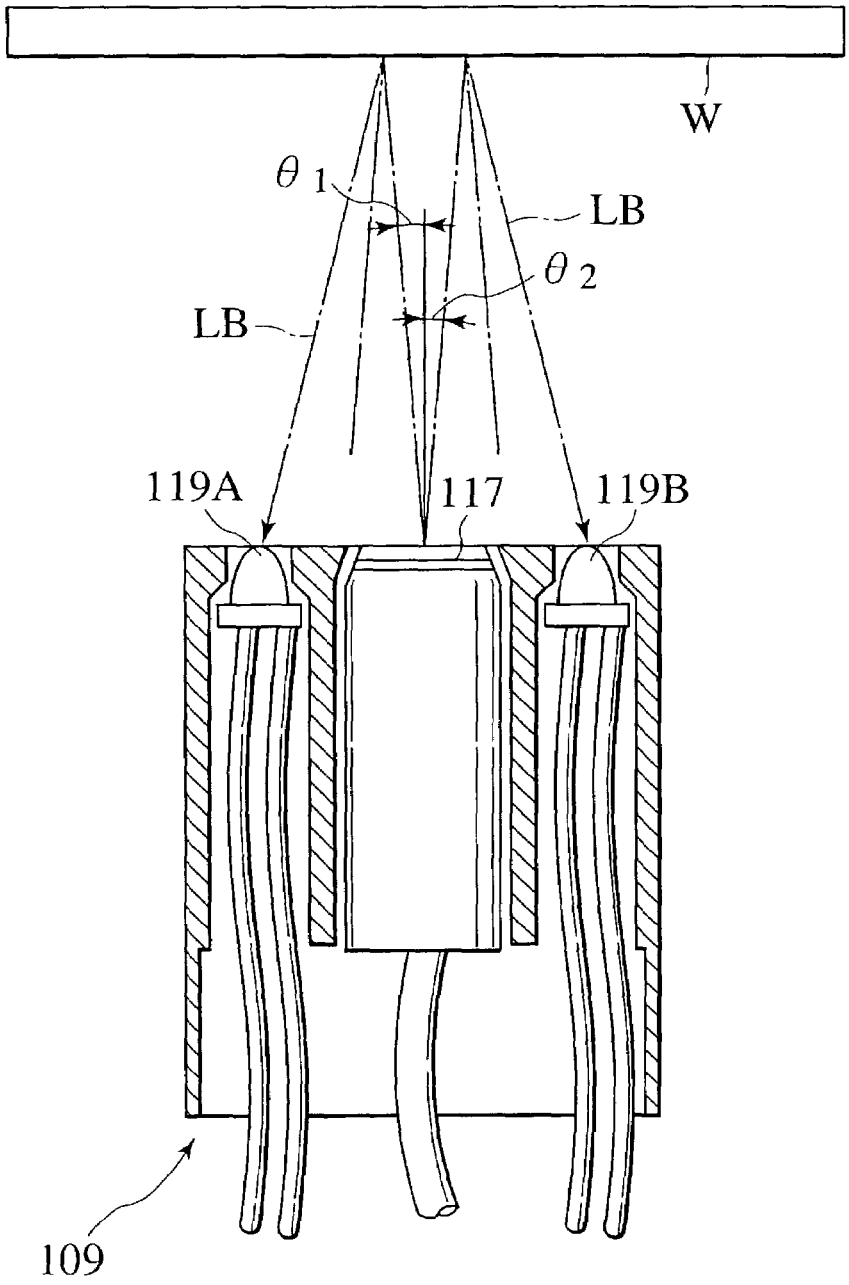
FIG. 5 is a sectional view showing an internal configuration of a detection head according to the embodiment of the present invention.

Referring to FIG. 5, the detection head 109 includes a laser projector 117 as a light emitting element on its center, and first and second photo acceptance units 119A and 119B made of, for example photodiodes, respectively provided above and below the laser projector 117.

By referring to FIG. 5, description is now made of a case of detecting a bending angle $2\cdot\theta$ of the work W by using the detection head 109. A laser beam LB emitted from the laser projector 117 of the swinging detection head 109 is reflected on a surface of the work W, received by the first and second photo acceptance units 119A and 119B, then converted into a signal and transmitted to the control unit 97. That is, the control unit 97 detects that when rotation is made up to a position where an angle of the detection head 109 reaches $\theta 1$, the laser beam LB emitted from the laser projector 117 is reflected on the work W, and a quantity of the reflected light received by the first photo acceptance unit 119A becomes maximum.

For example, regarding a change in a quantity of received reflected light with respect to a rotational angle of the detection head 109, generally, a quantity of received light by the first photo acceptance unit 119A becomes maximum when the detection head is rotated counterclockwise by an angle $\theta 1$ with respect to a reference angle $\theta$ ($\theta=0$ in the example shown in FIG. 5). A quantity of received light by the second photo acceptance unit 119B becomes maximum when the detection head 109 is rotated clockwise by an angle $\theta 2$ with respect to the reference angle $\theta$.

The first and second photo acceptance units 119A and 119B are provided at equal distances from the laser projector 117. Accordingly, it can be understood that in an intermediate position between the angles of the detection head 109 when the quantities of light received by the first and second photo acceptance units 119A and 119B respectively become maximum, a laser beam LB from the laser projector 117 is projected perpendicularly to the bent work W. Thus, an angle $2\theta$ of the bent work W is obtained by $2\cdot\theta=\theta 1+\theta 2$.

Figure 6:
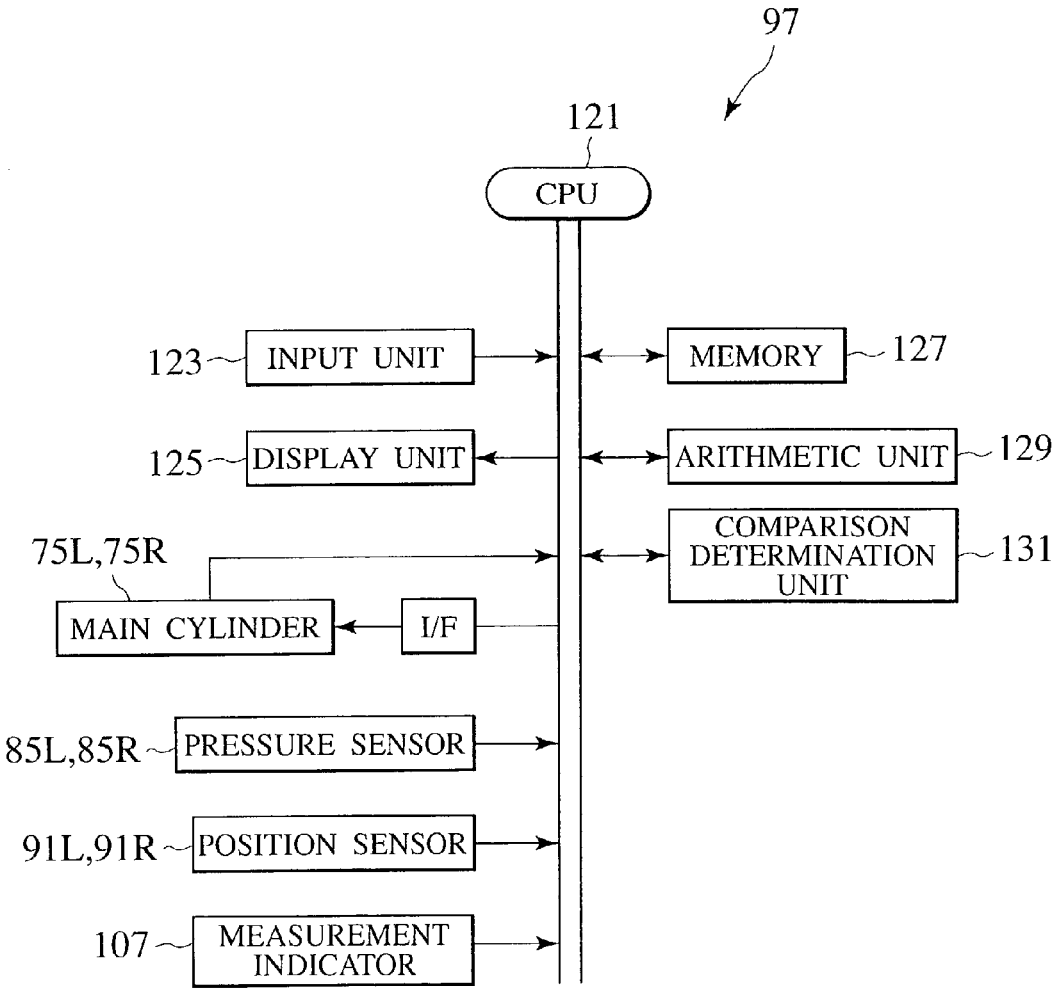
FIG. 6 is a block diagram showing a control unit of the bending machine (press brake) according to the embodiment of the present invention.

Referring to FIG. 6, the control unit 97 of the press brake 5 includes a CPU 121. An input unit 123 such as a keyboard for entering various data, and a display unit 125 such as a CRT for displaying various data are connected to the CPU 121. In addition, the main cylinders 75L and 75R, the pressure sensors 59L and 59R, the position sensors 91L and 91R, and the measurement indicator 107 are connected to the CPU 121.

A memory 127 is connected to the CPU 121. This memory 127 receives and stores data entered from the input unit 123 regarding die conditions including a punch tip are PR, a punch tip angle PA, a punch tip slope length PL, a punch bending constant PT, a die shoulder radius DR, a die groove angle DA, and a die V width V, and material conditions including a material, a plate thickness T, a bending length B, and a friction coefficient.

The memory 127 is constructed to fetch in and store the actual plate thickness and material constants of each blank calculated by the plate thickness/material constant detection unit 39 of the control unit 19 of the turret punch press 3, the results determined by the elongation error determination unit 63, the D value bending error determination unit 65 and the pinching-in angle bending error determination unit 67, and data obtained when determination is made by each of the determination units 63, 65 and 67, for example an elongation value, a stroke amount, a spring-back amount, a pinching-in angle and the like of each blank calculated based on the actual plate thickness and material constants of each blank, which are electrically transmitted from the control unit 19 of the turret punch press 3.

Further, an arithmetic unit 129 is connected to the CPU 121, which calculates a proper bending condition of each blank based on the data electrically transmitted from the control unit 19 of the turret punch press 3. A comparison determination unit 131 is also connected to the CPU 121, which issues a command for comparing the proper bending condition of each blank calculated by the arithmetic unit 129 with the actual bending load, the actual stroke amount and the actual pinching-in angle detected by the pressure sensors 59L and 59R, the position sensors 91L and 91R, and the measurement indicator 107 for each bending work carried out by an optional angle at the press brake 5 and for thus performing proper bending.

In the described embodiment, the elongation error determination unit 63, the D value bending error determination unit 65, and the pinching-in angle bending error determination unit 67 are provided in the control unit 19 of the turret punch press 3. However, these components may be provided in the control unit 97 of the press brake 5.

Next, description will be made of a plate material processing method using the plate material processing system constructed in the foregoing manner according to the first embodiment.

Figure 7:
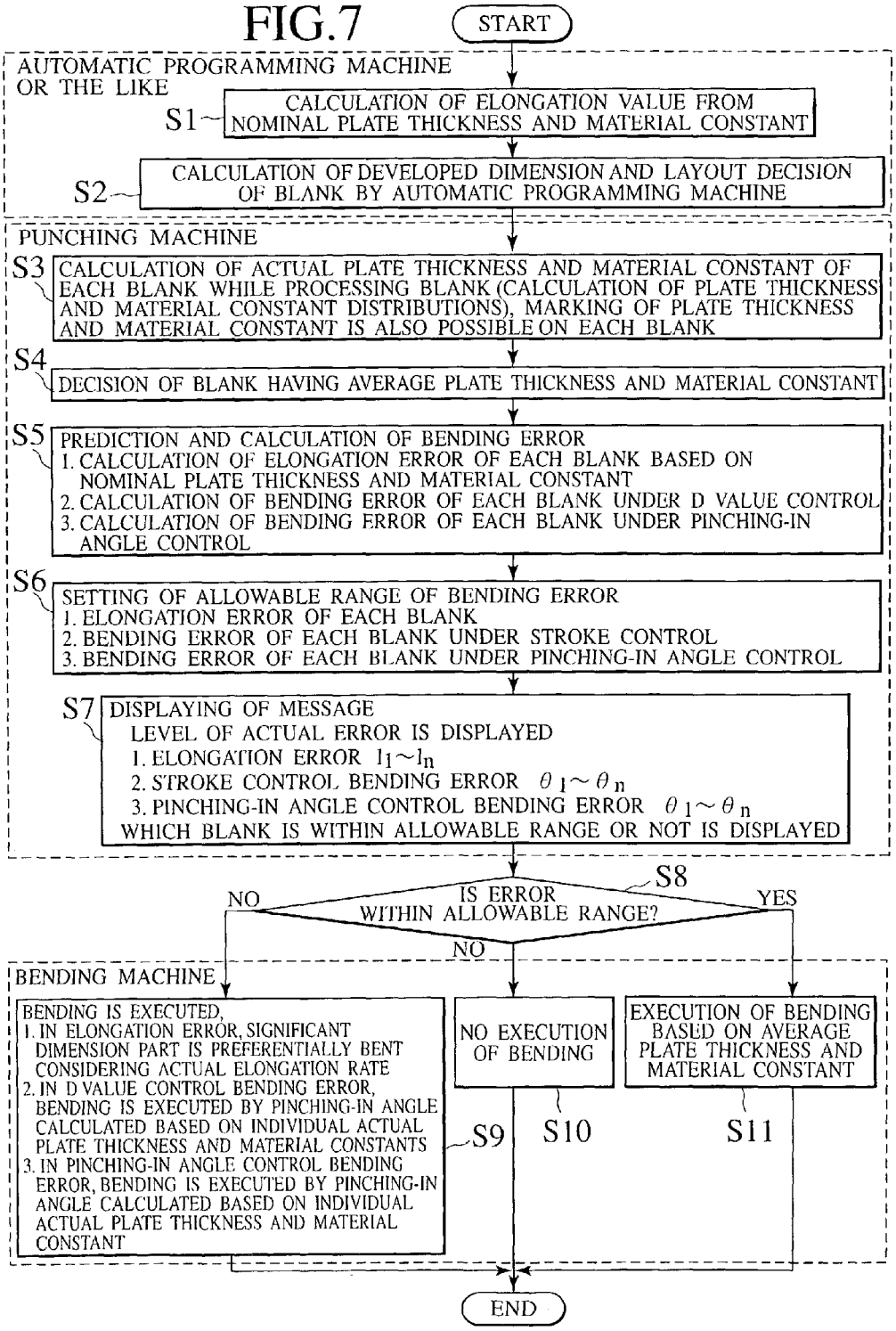
FIG. 7 is a flowchart showing a first embodiment of the present invention.

Referring to FIG. 7, the automatic programming machine 1 receives entry of data including the nominal plate thickness and the nominal material constants (tensile strength, Young's modulus, n value, f value, and the like) of the work W.

Figure 8:
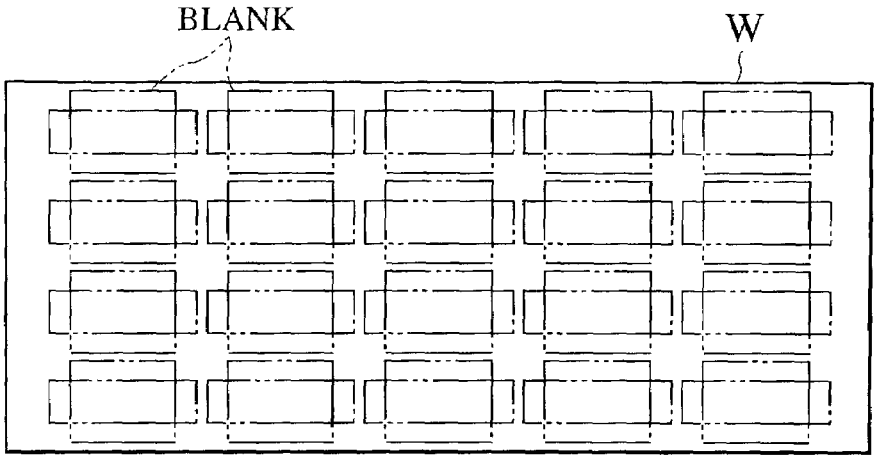
FIG. 8 is a development elevation showing a blank layout of each blank on a work sheet according to the first embodiment.

The elongation value of each blank is calculated based on these nominal plate thickness and material constants, and then developed dimensions are calculated. For the work W, a blank layout of each blank in the work W is decided as shown in FIG. 8 (steps S1 and S2).

A processing program containing development data of each blank is transmitted to the control unit 97 of the turret punch press 3 as shown in FIG. 1. At the turret punch press 3, each blank is subjected to actual punching based on the processing program, thereby carrying out blanking.

Figure 9:
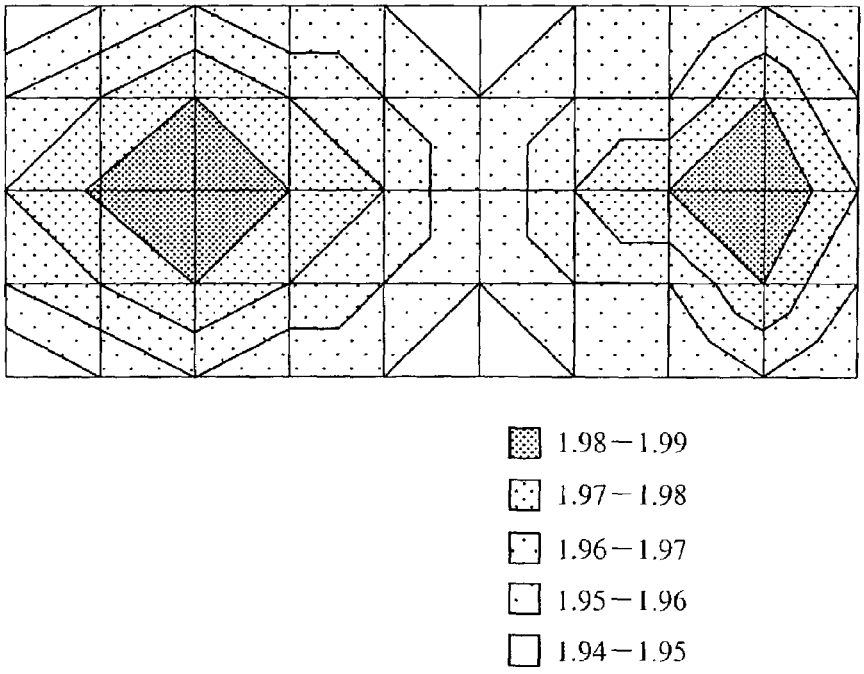
FIG. 9 is a view showing a plate thickness distribution on the work sheet according to the first embodiment.

At the plate thickness/material constant detection unit 39 of the control unit 19, as described above, each time when each blank is subjected to punching, various data containing the ram stroke and the pressure are detected, and the plate thickness and the material constants such as a tensile strength in each punching position are calculated based on the stroke value and a load. Thus, the actual plate thickness distribution and the material constant distribution of the work W are calculated, for example as shown in FIG. 9.

Therefore, the actual plate thickness and the material constants of each blank are decided from the above-described plate thickness and material constant distributions. When each blank is subjected to punching, a blank identification code, the plate thickness, the tensile strength and the like may be simultaneously marked. For example, on each blank, a plate thickness t of 0.8 mm, a tensile strength of $2.94\times10^8$ Pa (30 kg/mm$^2$), an identification code (A), (B), (C) or the like can be written down (step S3).

Among the blanks, a particular blank having the average plate thickness and the average tensile strength is extracted. For example, assuming that among three blanks, a blank (A) has a plate thickness t of 0.80 mm and a tensile strength of $2.94\times10^8$ Pa (30 kg/mm$^2$), a blank (B) has a plate thickness t of 0.81 mm and a tensile strength of $3.04\times10^8$ Pa (31 kg/mm$^2$), and a blank (C) has a plate thickness t of 0.82 mm and a tensile strength of $3.14\times10^8$ Pa (32 kg/mm$^2$), the blank (B) is the particular average blank (step S4) among these blanks.

Then, at the control unit 19, at least one of the following three bending errors is predicted based on the above-described actual plate thickness and material constants of each blank (step S5).

1. An elongation error of each blank is calculated based on the nominal plate thickness and the nominal material constants.

2. A bending error of each blank under D value control is calculated based on the actual plate thickness and the actual material constants of each blank.

3. A bending error of each blank under pinching-in angle is calculated based on the actual plate thickness and the actual material constants of each blank.

The "1. elongation error of each blank" is now explained more in detail. At the plate thickness/material constant detection unit 39 of the control unit 19, the elongation value of each blank is calculated based on the actual plate thickness and the actual material constants of each blank. A difference between this elongation value of each blank and the elongation value obtained based on the nominal plate thickness and the nominal material constants of the work W becomes the "elongation error".

The elongation value is obtained from the plate thickness and the material of each blank [elongation value=f (plate thickness, material, and die V width)].

Figure 10:
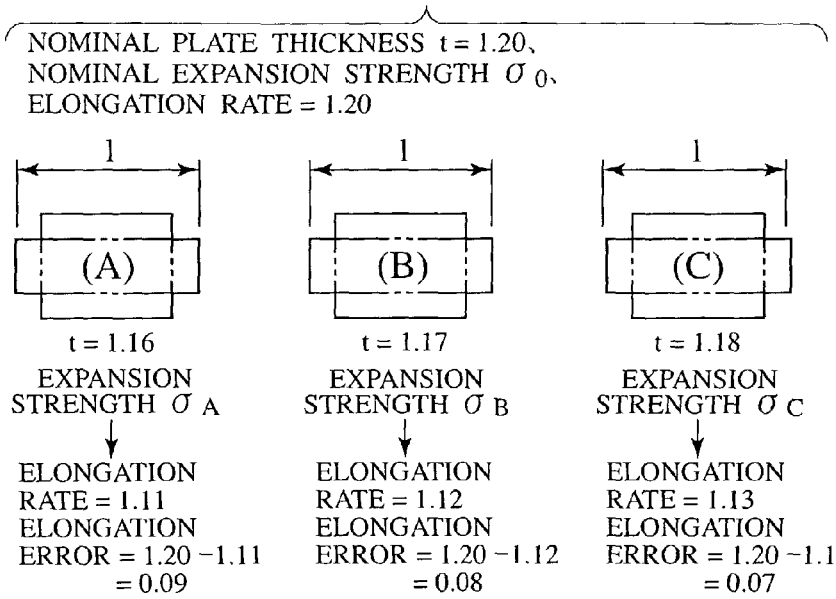
FIG. 10 is an explanatory view showing an "elongation error" according to the first embodiment.

For example, as shown in FIG. 10, for the blank (A), the elongation value is calculated at 1.11 mm based on a plate thickness t of 1.16 mm and a tensile strength σA. For the blank (B), the elongation value is calculated at 1.12 mm based on a plate thickness t of 1.17 mm and a tensile strength σB. For the blank (C), the elongation value is calculated at 1.13 mm based on a plate thickness t of 1.18 mm and a tensile strength σC.

The elongation value calculated based on the nominal plate thickness and the nominal material constants by the automatic programming machine 1 in step S1 has been entered to the memory 61 of the control unit 19. For example, if the elongation value calculated from a nominal plate thickness t of 1.20 mm and a tensile strength σ0 is 1.20 mm, a difference between the actual elongation value of each blank and this elongation value of 1.20 mm becomes the "elongation error".

Thus, the elongation errors are respectively calculated to be 0.09 mm, 0.08 mm, and 0.07 mm for the blanks (A), (B) and (C).

The "2. bending error of each blank under D value control" is now explained more in detail. At the plate thickness/material constant detection unit 39 of the control unit 19, the D value (stroke amount) when the blank having the average plate thickness and the average material constants among the blanks is bent by a predetermined angle is calculated based on the actual plate thickness and the actual material constants. A difference between an angle of another blank bent by the same stroke amount and the predetermined angle becomes the "D value control bending error".

Figure 11:
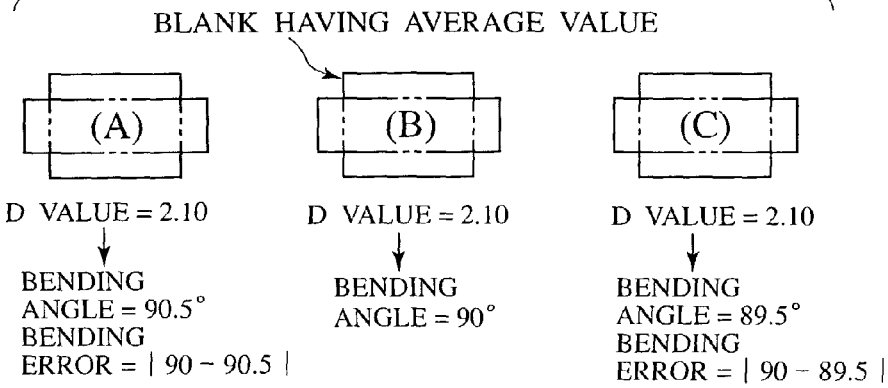
FIG. 11 is an explanatory view showing a "D value control bending error" according to the first embodiment.

For example, as shown in FIG. 11, the D value when the blank (B) having the average plate thickness and the average material constants is bent by a predetermined angle 90° is calculated based on the actual plate thickness and the actual material constants of the blank (B). This calculated D value is now assumed to be 2.10.

For the other blanks (A) and (C), the bending angles with the D value equal to the calculated D value of the blank (B) are calculated based on the actual plate thickness and the actual material constants of the individual blanks (A) and (C). As a result, since the bending angle of the blank (A) is 90.5°, the bending error is 0.5°. Since the bending angle of the blank (C) is 89.5°, the bending error is 0.5°.

The "3. bending error of each blank under pinching-in angle control" is now explained more in detail. At the plate thickness/material constant detection unit 39 of the control unit 19, the spring-back amount of the blank having the average plate thickness and the average material constants among the blanks is calculated based on the actual plate thickness and the actual material constants. From this spring-back amount, the pinching-in angle is calculated for achieving a predetermined finishing angle. The finishing angle after another blank is bent to the similar pinching-in angle is calculated based on the individual actual plate thickness and material constants. A difference between the finishing angle when another blank is bent to the similar pinching-in angle and the above-described predetermined angle becomes the "pinching-in angle control bending error".

Figure 12:
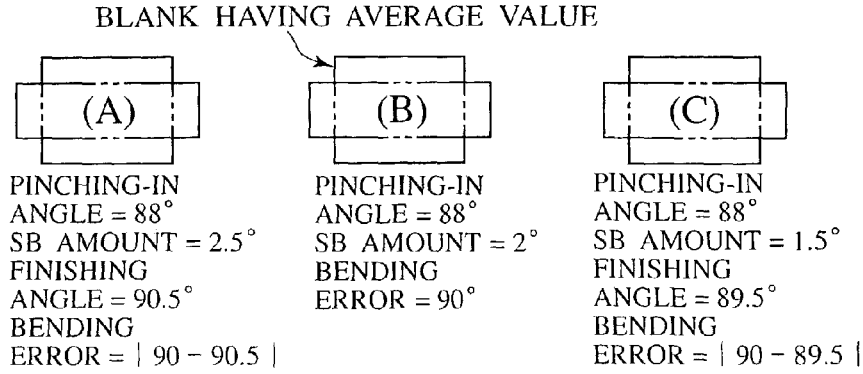
FIG. 12 is an explanatory view showing a "pinching-in angle control bending error" according to the first embodiment.

For example, as shown in FIG. 12, since the spring-back amount of the blank (B) having the average plate thickness and the average material constants is calculated to be 2.0°, the pinching-in angle for bending by a predetermined angle of 90° is 88°.

For the other blanks (A) and (C), the finishing angles when they are bent to the pinching-in angles similar to the calculated pinching-in angle 88° of the blank (B) are obtained from the spring-back amounts calculated based on the individual actual plate thickness and material constants. As a result, since the spring-back amount and the finishing angle of the blank (A) are respectively 2.5° and 90.5°, the bending error is 0.5°. Since the spring-back amount and the finishing angle of the blank (C) are respectively 1.5° and 89.5°, the bending error is 0.5° (step S5 thus far).

For the foregoing three types of errors, i.e., the elongation error of each blank, the bending error of each blank under D value control, and the bending error of each blank under pinching-in angle control, allowable ranges are set (step S6).

A message as to how much an actual error is deviated from the allowable range, and which blank has the error within the allowable range is displayed on the not shown display unit of the control unit 19, for example as shown in FIG. 13 (step S7).

Referring to FIG. 7, whether each of the above-described errors is within the allowable range or not is determined by each of the following determination units of the control unit 19 (step S8).

Regarding the "elongation error", the elongation error determination unit 63 determines whether an "elongation error" of each blank is within the allowable range or not.

In the case of the blank having the "elongation error" outside the allowable range, the blank is bent such that a significant dimension part of the blank is set to a predetermined dimension. For example, in order to pass up the elongation error to the other flange, the significant dimension part is first bent (step S9). Alternatively, in the case of the blank having an "elongation error" outside the allowable range, no bending work is carried out (step S10).

In the case of the blank having an "elongation error" within the allowable range, normal bending work is carried out at the press brake 5 (step S11).

Regarding the "D value control bending error", the D value bending error determination unit 65 determines whether the "D value control bending error" of each blank is within the allowable range or not.

In the case of the blank having the "D value control bending error" outside the allowable range, an alarm is displayed to an operator. In this case, the operator calculates the D value (stroke amount) with respect to a predetermined angle based on the individual actual plate thickness and material constants of each blank. Accordingly, since bending is carried out at the press brake 5 by using the D value stroke amount with respect to the predetermined angle, the finishing angle is surely set within the allowable range (step S9). Alternatively, in the case of the blank having the "D value control bending error" outside the allowable range, no bending work is carried out (step S10).

In the case of the blank having the "D value control bending error" within the allowable range, normal bending work is carried out at the press brake 5 by the D value based on the average plate thickness and the average material constants (step S11).

Regarding the "pinching-in angle control bending error", the pinching-in angle bending error determination unit 67 determines whether the "pinching-in angle control bending error" of each blank is within the allowable range or not.

In the case of the blank having the "pinching-in angle control bending error" outside the allowable range, as in the case of the above-described D value control, the spring-back amount is obtained based on the actual plate thickness and the material constants of each blank, and the pinching-in angle with respect to a predetermined angle is calculated based on this spring-back amount. Accordingly, since bending work is carried out at the press brake 5 by using the pinching-in angle with respect to the predetermined angle, the finishing angle is surely set within the allowable range (step S9). Alternatively, in the case of the blank having the "pinching-in angle control bending error" outside the allowable range, no bending work is carried out (step S10).

In the case of the blank having the "pinching-in angle control bending error" within the allowable range, normal bending work is carried out at the press brake 5 (step S11).

As described above, the actual plate thickness and the actual material constants of each blank are measured during punching in blanking work before bending, and this measurement information is reflected on bending. Thus, efficient and accurate bending is carried out. Moreover, for example, a block of blanks having small bending errors simplifies work in the inspection time. Thus, the inspection time after bending is shortened.

Next, description will be made of another plate material processing method using the plate material processing system of the foregoing configuration according to a second embodiment. Explanation of portions similar to those of the first embodiment is omitted.

The second embodiment is different from the first embodiment in that for detection of the actual plate thickness distribution and the actual material constant distribution of a work W, these are obtained at the turret punch press 3 during blanking by punching of each blank in the first embodiment, while they are obtained during trial-punching at waste holes in the second embodiment, and blanking is carried out after the determination as to whether each of the foregoing bending errors is within the allowable range or not.

Figure 14:
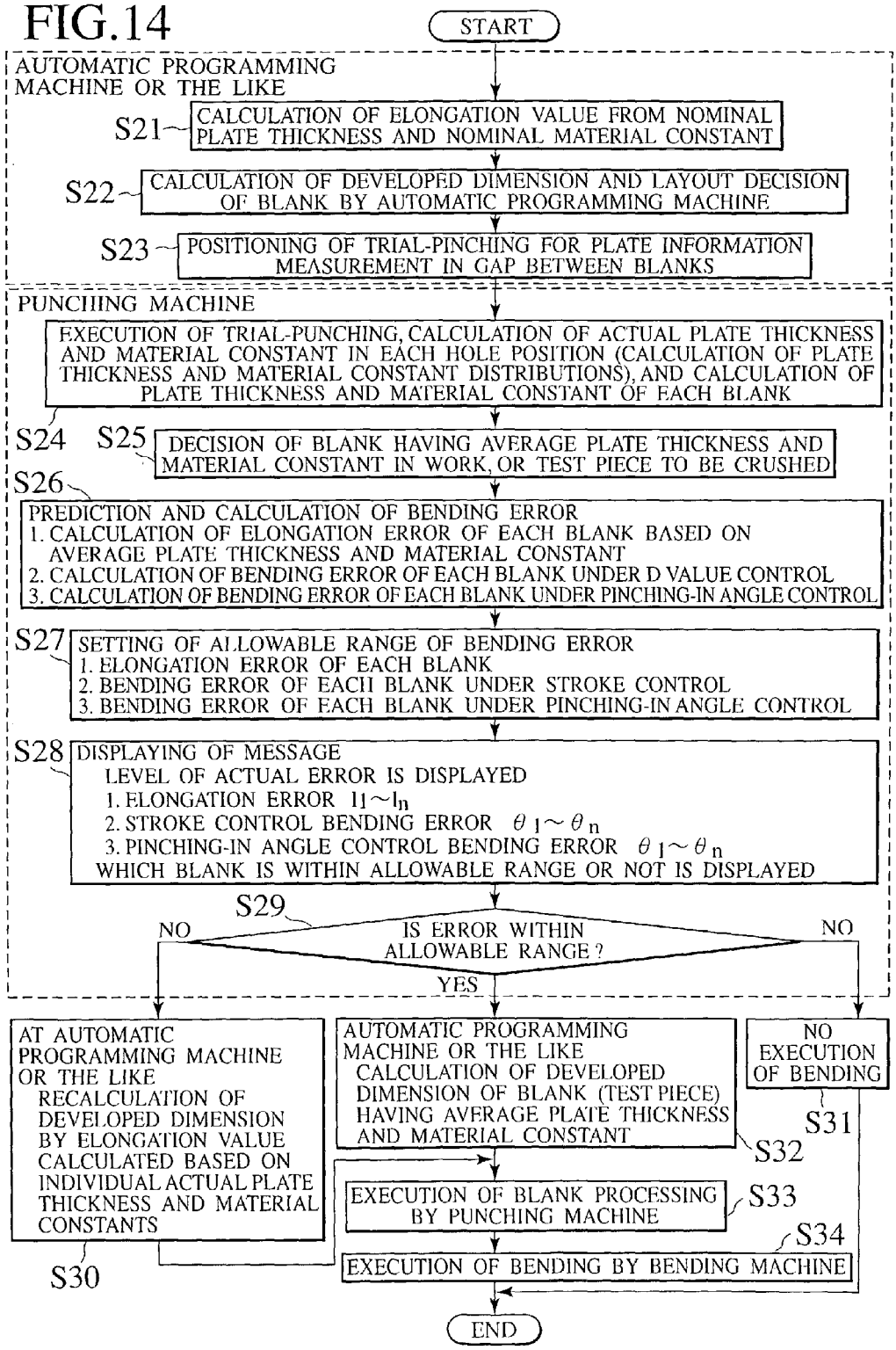
FIG. 14 is a flowchart showing a second embodiment of the present invention.

Referring to FIG. 14, steps S21 and S22 are similar to steps S1 and S2 in FIG. 7.

Figure 15:
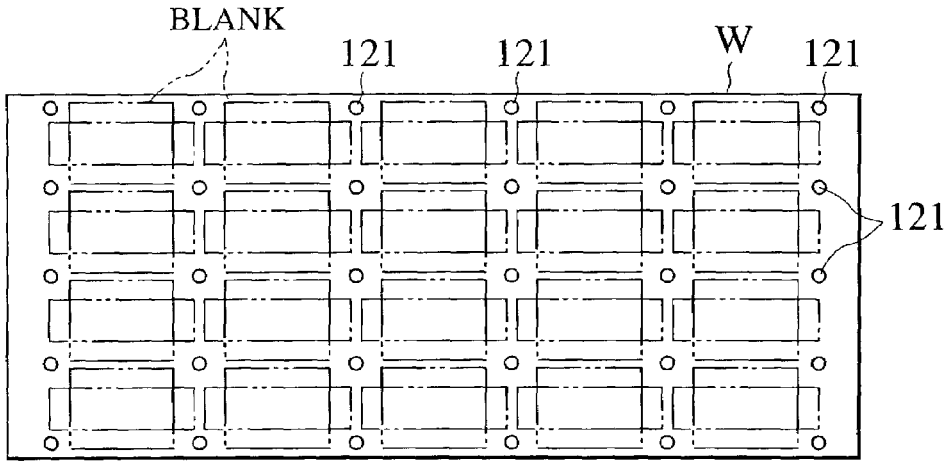
FIG. 15 is a blanking development elevation of a waste hole and each blank on a work sheet according to the second embodiment.

For the work W, as shown in FIG. 15, a blank layout is decided for each blank, and waste holes 133 of trial-punching for plate information measurement are positioned among the blanks (step S23).

Figure 16:
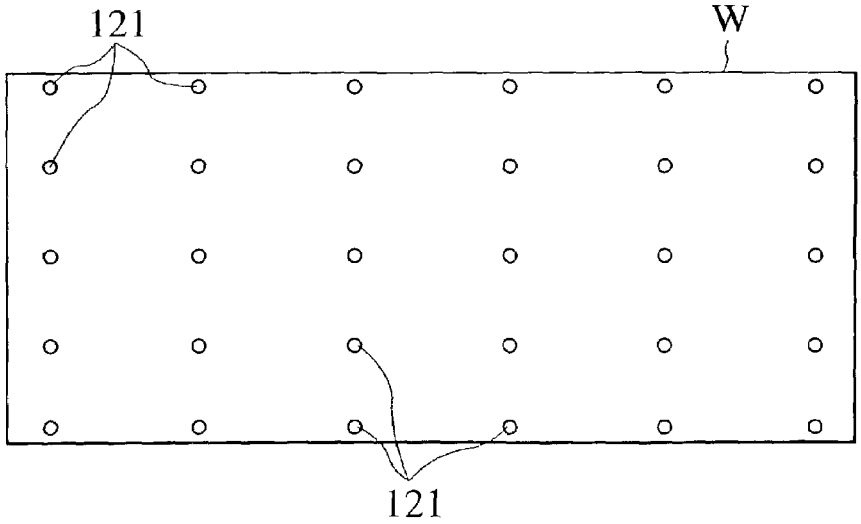
FIG. 16 is a view showing a punching state of the waste hole on the work sheet according to the second embodiment.

A processing program containing development data of the waste holes 133 for trial-punching and each blank on the work W is transmitted to the control unit 19 of the turret punch press 3. At the turret punch press 3, as shown in FIG. 16, the waste holes 133 are subjected to actual punching based on the processing program. However, each blank is not punched.

At the plate thickness/material constant detection unit 39 of the control unit 19, the plate thickness and the material constants such as a tensile strength in each punching position are calculated during punching of each waste hole 133. Thus, as shown in FIG. 9, an actual plate thickness distribution and an actual material constant distribution of the work W are calculated. This processing is substantially similar to step S3 of the first embodiment shown in FIG. 7.

Therefore, the actual plate thickness and the material constants of each blank are decided from the above-described plate thickness and material constant distributions (step S24).

Figure 17:
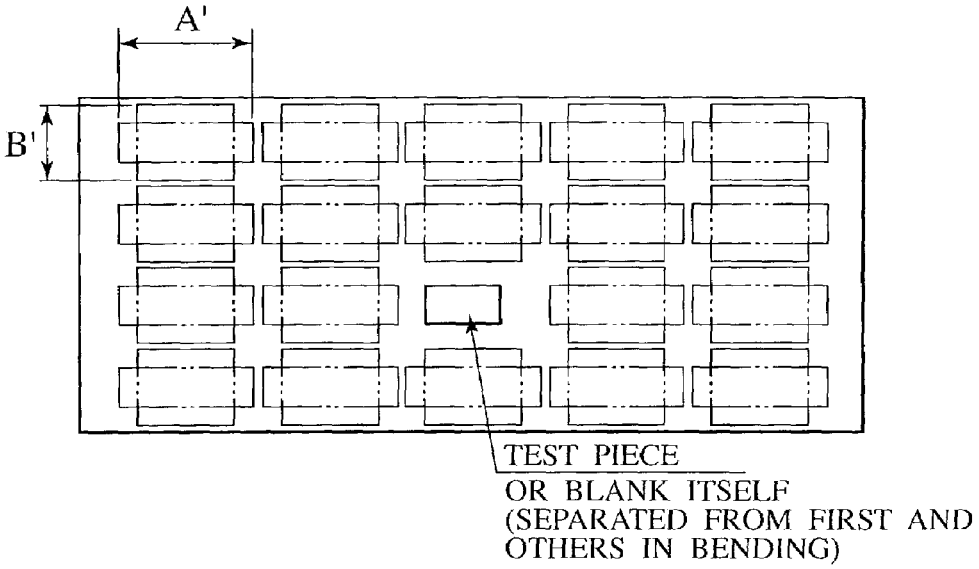
FIG. 17 is an explanatory view showing a position of a test piece on the work sheet according to the second embodiment.

Among the blanks, a particular blank having the average plate thickness and the average tensile strength is extracted as in the case of step S4 of the first embodiment shown in FIG. 7. Alternatively, as shown in FIG. 17, a test piece to be crushed is decided (step S25).

Then, at the control unit 19, at least one of three bending errors, i.e., an "elongation error", a "D value control bending error", and a "pinching-in angle control bending error" is predicted based on the above-described actual plate thickness and material constants of each blank.

The "elongation error" is now explained more in detail. At the plate thickness/material constant detection unit 39 of the control unit 19, an elongation value of each blank is calculated based on the actual plate thickness and the actual material constants of each blank. On the other hand, the "average elongation value" is calculated based on the actual plate thickness and the actual material constants of the blank having the average plate thickness and the average material constants among the blanks. A difference between this average elongation value and the actual elongation value of each blank becomes the "elongation error".

The "D value control bending error" and the "pinching-in angle control bending error" are similar to those in step S5 of the first embodiment shown in FIG. 7 (step S26).

Steps S27 and S28 are similar to steps S6 and S7 of FIG. 7.

Referring to FIG. 14, whether each of the above-described errors is within the allowable range or not is determined by each of the following determination units of the control unit 19 (step S29).

Regarding the "elongation error", the elongation error determination unit 63 determines whether the "elongation error" of each blank is within the allowable range or not.

In the case of the blank having the "elongation error" outside the allowable range, at the automatic programming machine 1 or the like, an developed dimension is calculated again by the elongation value calculated based on the actual plate thickness and the actual material constants of each blank (step S30). Alternatively, in the case of the blank having the "elongation error" outside the allowable range, no bending work is carried out (step S31).

In the case of the blank having an "elongation error" within the allowable range, at the automatic programming machine 1 or the like, a developed dimension is calculated based on the elongation value of the blank having the average plate thickness and the average material constants or the test piece (step S32).

Then, at the turret punch press 3, each blank is punched and subjected to blanking based on the developed dimension of steps S30 and S32 (step S33).

Each blank is bent at the press brake 5 (step S34).

That is, regarding the "D value control bending error" and the "pinching-in angle control bending error", determination is made as to whether the "D value control bending error" or the "pinching-in angle control bending error" of each blank is within the allowable range or not, and then bending work similar to that in step S9 or S11 of the first embodiment is carried out.

Alternatively, in the case of the blank having the "D value control bending error" and the "pinching-in angle control bending error" outside the allowable range, no bending work is carried out (step S31).

As described above, the actual plate thickness distribution and the actual material constant distribution of the work are measured during trial-punching before bending. Thus, the actual plate thickness and the actual material constants of each blank are decided, and this measurement information is reflected on accurate development and blanking of each blank. Since the measurement information is also reflected on bending, efficient and accurate bending is carried out. Moreover, for example, a block of blanks having small bending errors simplifies work in the inspection time. Thus, the inspection time after bending is shortened.

In the foregoing embodiment, the calculation of the bending error or the like is carried out in the control unit of the punching machine. However, the calculation may be carried out by other computers through a network or the like.

Generally, sheet metal processing accuracy includes dimensional accuracy in punching, dimensional accuracy in cutting width, and bending angle accuracy. In order to obtain high bending angle accuracy thereamong, a skill of a highest level is required. For the purpose of reducing this skill requirement, various bending angle detectors, mechanisms or the like have been developed.

However, in the case of the conventional sheet metal processing system, for carrying out highly accurate bending satisfying the above-described need, necessity of a conventionally practiced trial-bending step has been a problem.

The following embodiment has been made to solve such a problem, and it is designed in brief to eliminate the necessity of trial-bending or reduce the number of trial-bending times by detecting beforehand a true plate thickness or a true spring-back amount of each blank to be bent beforehand in blanking step.

Figure 18:
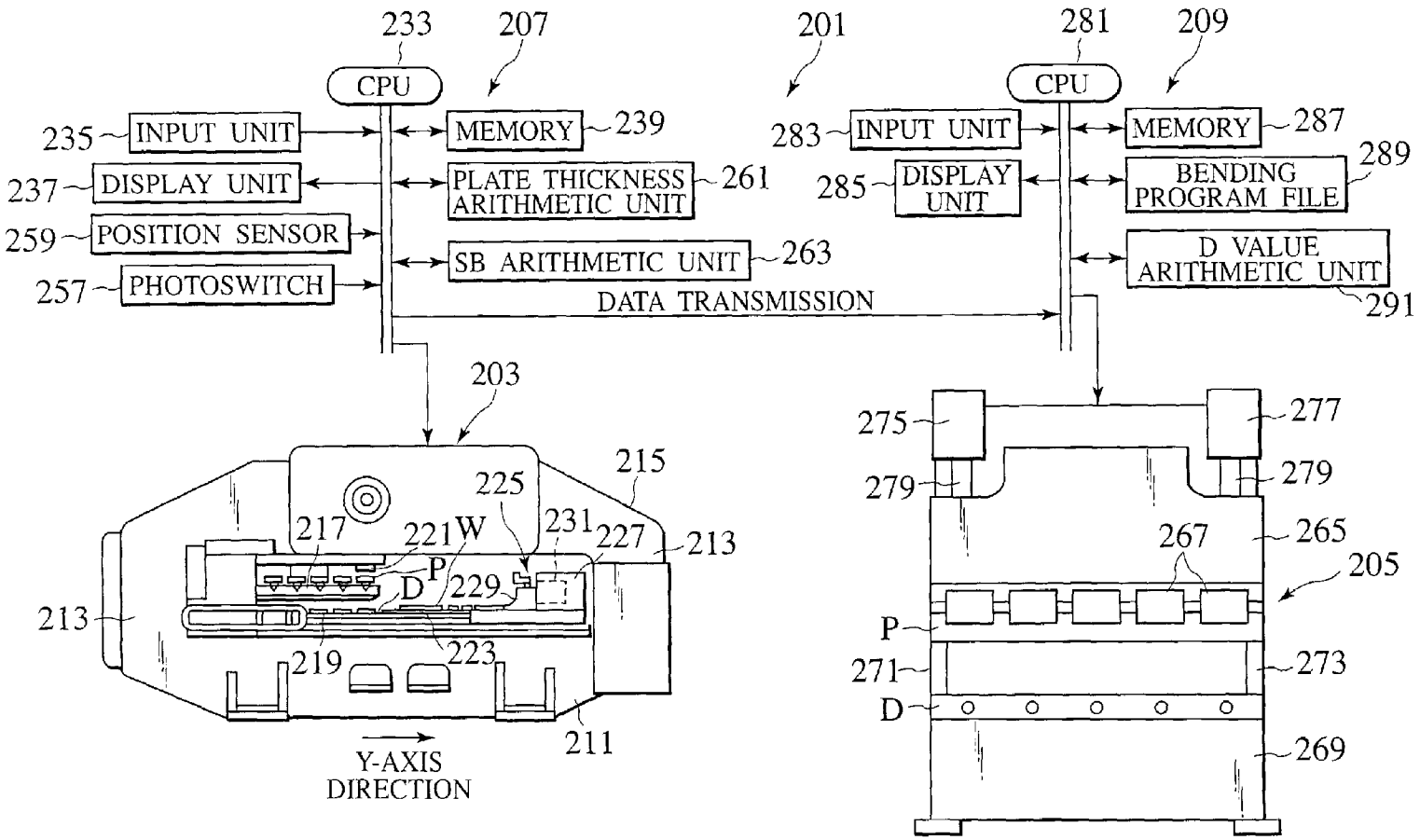
FIG. 18 is an explanatory view schematically showing a sheet metal processing system according to a third embodiment.

Referring to FIG. 18, at a sheet metal processing system 201, as a generally used blank processing machine, a punch press such as a turret punch press 203, a laser processing machine, or a punch laser combination processing machine is used. The blank processing machine includes a work characteristic detection unit loaded to detect a plate thickness of the work W and a spring-back amount during bending.

Thus, at the blank processing machine, punching and laser cutting are executed to carry out blanking and, simultaneously, plate thickness measurement and spring-back amount detection are carried out by the work characteristic detection unit. Then, in a next bending step by the bending machine, such as a press brake 205, data of the above-described plate thickness and spring-back amount is used as a control parameter, and thus the hitherto practiced trial-bending step is made unnecessary. That is, since the material characteristics of the work W, e.g., a tensile strength $\sigma$, a work hardening coefficient C and the like, are obtained based on the data of the plate thickness and the spring-back amount, the obtained material characteristics are used in bending.

A basic idea of the present invention is as follows. To carry out highly accurate bending, in bending work using the press brake 205, it is necessary to control positioning of a movable table in such a way as to set the following while the work W is interposed between dies:

Control target bending angle $\alpha$=drawing designated angle $\theta$+spring-back angle $\epsilon$.

Moreover, to reach the drawing designated angle $\theta$ with high accuracy, it is necessary to clearly set conditions of a die dimension including a die V groove width dimension, a die shoulder radius and a punch tip radius, and the material characteristics including the plate thickness t, and the tensile strength $\sigma$. The plate thickness t has a relation of square, and the tensile strength $\sigma$ has a strong correlation.

Similarly, as conditions for understanding the spring-back angle $\epsilon$, it is necessary to clearly set material characteristics including the target bending angle $\theta$, the plate thickness t, the work hardening coefficient C, an index n, and elastic modulus, and the die dimension including the punch tip radius. Then, a relation of $\sigma=C\epsilon n$ is set between the work hardening coefficient C and the index n.

The die dimension is uniquely decided when the model number of the die to be used in bending is clarified.

As apparent from the foregoing, in order to accurately obtain a drawing designated angle $\theta$, it is only necessary to understand the plate thickness t and the tensile strength equivalent value (numerical value representing tensile strength) of the work W, each having a strong correlation with each angle.

Thus, since the spring-back angle $\epsilon$ has a strong correlation with the tensile strength $\sigma$, a measured value of the spring-back angle $\epsilon$ can be applied to the condition for obtaining the highly accurate drawing designated angle $\theta$. In other words, in the present invention, the spring-back angle $\epsilon$ is treated as the numerical value representing the tensile strength $\sigma$ of the work W.

In addition, as widely known, even if same control is executed, angles after removal of a bending force are different from each other between bending parallel to a rolling direction and bending in a perpendicular direction. A main cause of this may be a difference in tensile strength $\sigma$ between the respective directions. Accordingly, in any directions, to obtain a highly accurate bending angle, it is necessary to understand numerical values (material characteristic values) representing individual tensile strengths of the directions parallel and perpendicular to the rolling direction, and separately use these in bending.

Based on the foregoing, at the sheet metal processing system 201 of the present invention, first, the plate thickness t of a member (including later-described sample) as a blank is measured. Then, blank processing such as punching or laser cutting is carried out. Directly in the same clamping state, bending parallel and bending perpendicular to a rolling direction of the sample are carried out by, for example a bending angle of 90°. Then, the spring-back amount $\epsilon$ is measured at the sample bent by 90° for each of the foregoing bending, and the measured value is stored as the material characteristic values in a control unit 207 of the blank processing machine. Thereafter, such material characteristic values are referred to in bending using the press brake 205.

That is, at the control unit 209 of the press brake 205, the material characteristic values are received from the control unit 207 of the blank processing machine, and control for positioning the movable table is executed by incorporating the material characteristic values in a bending angle control algorithm. For example, the actually measured plate thickness t is directly used, and the tensile strength equivalent values are separately used for each bending direction (parallel/perpendicular to rolling direction). Accordingly, it is possible to highly accurately obtain a target angle from first processing without executing trial-bending.

By referring to FIG. 18, explanation is now made of the embodiment using the blank processing machine, for example the turret punch press 203.

The turret punch press 203 is a known press and, in brief, it is formed in a frame structure, where both sides of an upper frame 215 are supported on side frames 213 erected in both sides of a base 211. On the lower portion of the upper frame 215, a disk-shaped upper turret 217 including a variety of punches P to be freely detached and exchanged is rotatably loaded. A lower turret 219 facing the upper turret 217 is rotatably loaded on an upper surface of the base 211. This lower turret 219 includes a number of dies D facing the variety of punches P, and the dies D are disposed in a circular-arc shape and loaded to be freely detached and exchanged. Shaft centers of the upper and lower turrets 217 and 219 are disposed on the same shaft center. The upper and lower turrets 217 and 219 are rotated in synchronization in the same direction by control of the control unit 207.

By rotations of the upper and lower turrets 217 and 219, desired punch P and die D are indexed and positioned below a ram 221 (punch press member) located in a processing position.

The turret punch press 203 also includes a work movement positioning device 225 for moving a plate-shaped work W placed on a processing table 223 back and forth, and left and right, and positioning it to the processing position. The work movement positioning device 225 includes a carriage base 227 provided on the right end of the processing table 223 in FIG. 18 so as to be freely moved in a Y axis direction. On this carriage base 227, a carriage 231 including a plurality of work clamps 229 for claming the work W is provided so as to be freely moved in an X axis direction. The work movement positioning device 225 is controlled by the control unit 207.

In the control unit 207, an input unit 235 such as a keyboard, and a display unit 237 such as a CRT are connected to a central processing unit, for example a CPU 233. By operating the input unit 235 and the display unit 237, a three-dimensional drawing, a development drawing or the like of a product is made, and a processing program for deciding a way of processing is prepared, and then stored in a memory 239. Based on this processing program, punching of the turret punch press 203 is controlled.

Thus, based on the processing program of the control unit 207, the work W is set in a processing position by the work movement positioning device 225, and then the punch P is struck by the ram 221. Thus, the work W is subjected to punching by cooperation between the punch P and the die D. Accordingly, for example a blank 241 shown in FIG. 19 is obtained.

Figure 19:
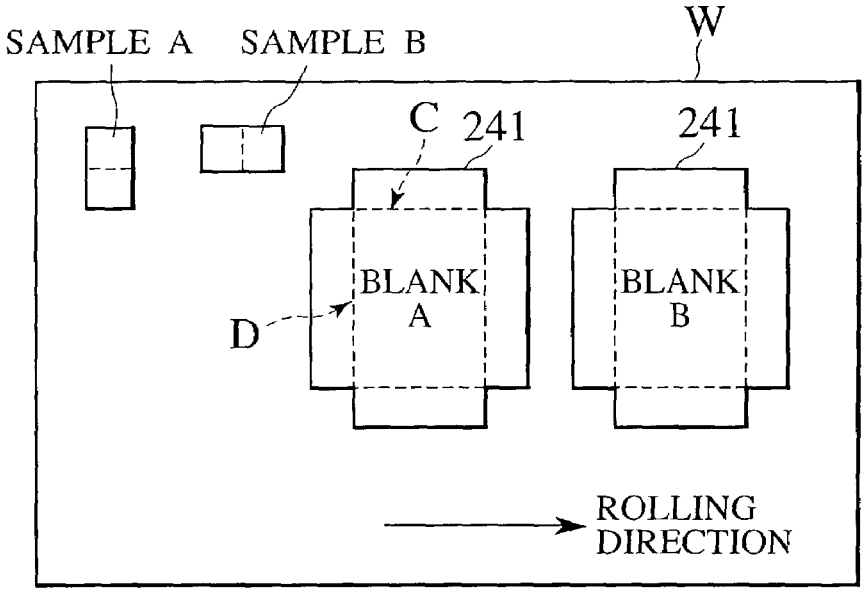
FIG. 19 is a plan view showing an example of a blank according to the third embodiment.

Referring to FIG. 19, for example, a sample A as a sample is used for obtaining the spring-back amount $\epsilon$ in bending parallel to a rolling direction in FIG. 19. For example, a sample B as a sample is used for obtaining the spring-back amount $\epsilon$ in bending perpendicular to the rolling direction.

Figure 20:
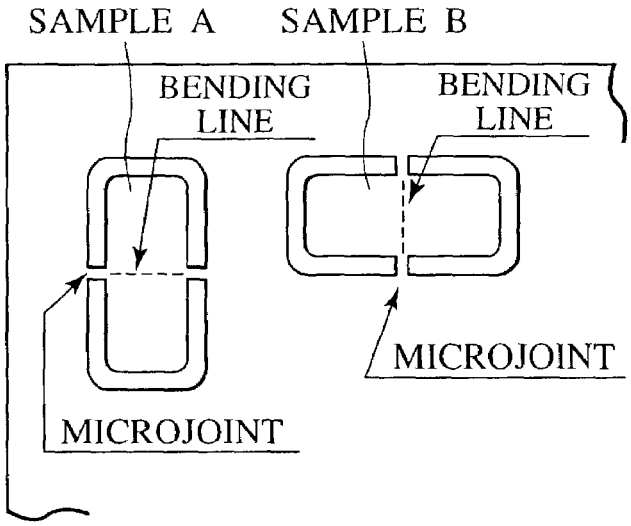
FIG. 20 is an explanatory view showing in detail a sample material of FIG. 19.

The blanks A and B are developed shapes of products and, by bending parts (C and D) indicated by dotted lines in the drawing, final product shapes (boxes in the example) are obtained. As shown in FIG. 20, the samples A and B are both in microjoint states and, in these states, the samples are bent by 90°. The blanks A and B are similarly in microjoint states.

The micro-joint has only a very small effect on the bending angle because its width is equal to/lower than 0.2 mm. Accordingly, the spring-back amount $\epsilon$ substantially equal to that in the case of no joint is obtained. The spring-back amount $\epsilon$ obtained in bending of the sample A is referred to when the C part shown in FIG. 19 is bent by using the press brake 205, and similarly the sample D is referred to when the D part is bent.

As described above, one of the features of the present embodiment is that the samples (two types of parallel/perpendicular) for the purpose of detecting spring-back amounts $\epsilon$ are processed in the same step as the processing of the blanks.

Next, description will be made of the work characteristic detection unit constituting a main portion of the embodiment, for example a measuring unit 243. This measuring unit 243 can detect the spring-back amount $\epsilon$ and measure the plate thickness.

Figure 21:
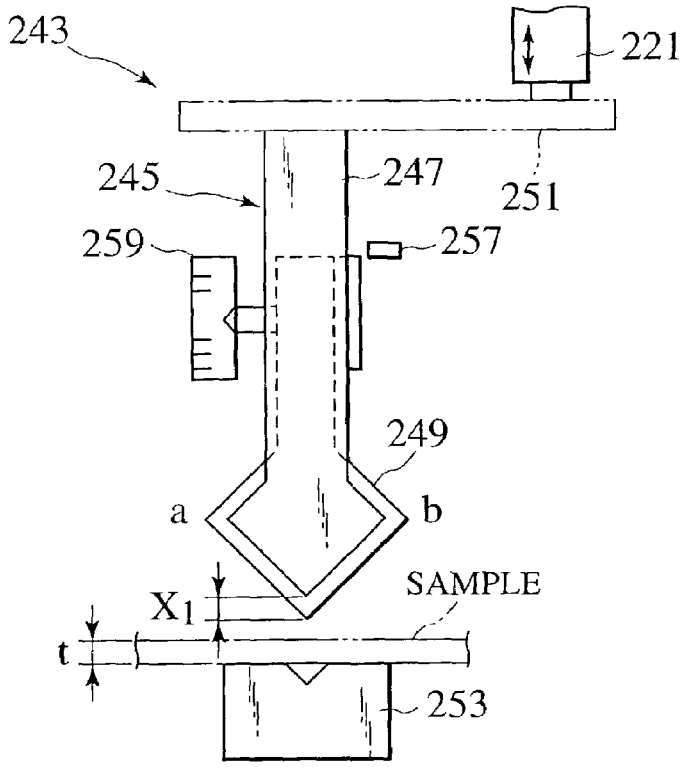
FIG. 21 is an explanatory view schematically showing a work characteristic detecting unit according to the embodiment of the present invention.
Figure 22:
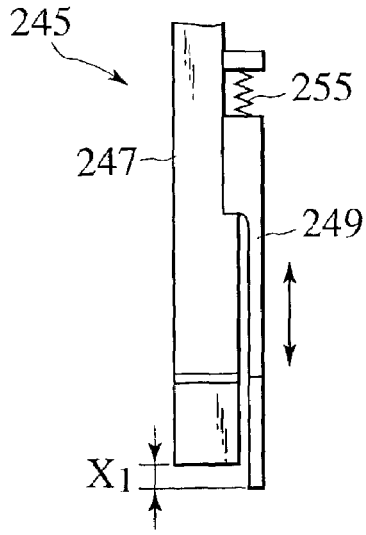
FIG. 22 is a view showing a right side of FIG. 21.

Referring to FIGS. 21 and 22, the measuring unit 243 can be divided into two modules, i.e., a probe module and a die module. In the embodiment, the former is incorporated in the upper turret 217 of the turret punch press 203, and the latter into the lower turret 219. However, both may be combined to constitute a single device. In this case, the device may be installed in any positions within a range, where the work W can be subjected to positioning control, and the device is effective when it is installed in the laser processing machine or the punch laser combination machine.

The probe unit 245 is made of probe members, for example a probe 247 and a sensor plate 249. The probe 247 is equivalent to a punch die in bending. When the ram 221 is lowered, the probe 247 itself is lowered through a striker 251. Bending is carried out by interposing the work W between the probe 247 and the die 253. A displacement amount of the ram 221 can be detected by position detecting means loaded on another not shown member.

The sensor plate 249 has a structure to be moved up and down relative to the probe 247, and is always pressed downward by a spring 255 so as to be protruded downward by a predetermined length (x1 in the embodiment) from a lower end of the probe 247. In addition, an upper end of the sensor plate 249 can be detected by a photoswitch 257 loaded on another not-shown member, and a displacement amount of the sensor plate 249 can be detected by a position sensor 259 in FIG. 21. The photoswitch 257 and the position sensor 259 are connected to the CPU 233 of the control unit 207.

Next, description will be made of a series of plate thickness detection and spring-back detection operation carried out by using the measuring unit 243. The plate thickness detection and the spring-back amount detection may be carried out as independent operations.

First, description is made of a principle of the plate thickness detection according to the embodiment.

Referring to FIGS. 21 and 22, as the probe unit 245 is gradually lowered, a tip of the sensor plate 249 is first bumped into the work W, for example a surface of the sample, and subsequently a tip of the probe 247 is bumped into the work W. During this period, as indicated by (1) in FIG. 24, the sensor plate 249 is raised by a displacement amount x1 relative to the probe 247, and the tip of the probe 247 is set in the state of being bumped. That is, in the state that vertical positions of the tips of the probe 247 and the sensor plate 249 coincide with each other (S point in FIG. 24), the photo switch 257 is turned on.

The probe unit 245 is lowered and pressed to a reference plate having the plate thickness clarified beforehand, i.e., the reference plate thickness t1, a position of the probe unit 245 when the photoswitch 257 is turned on is read by the position sensor 259 and stored in the memory 239.

Figure 24:
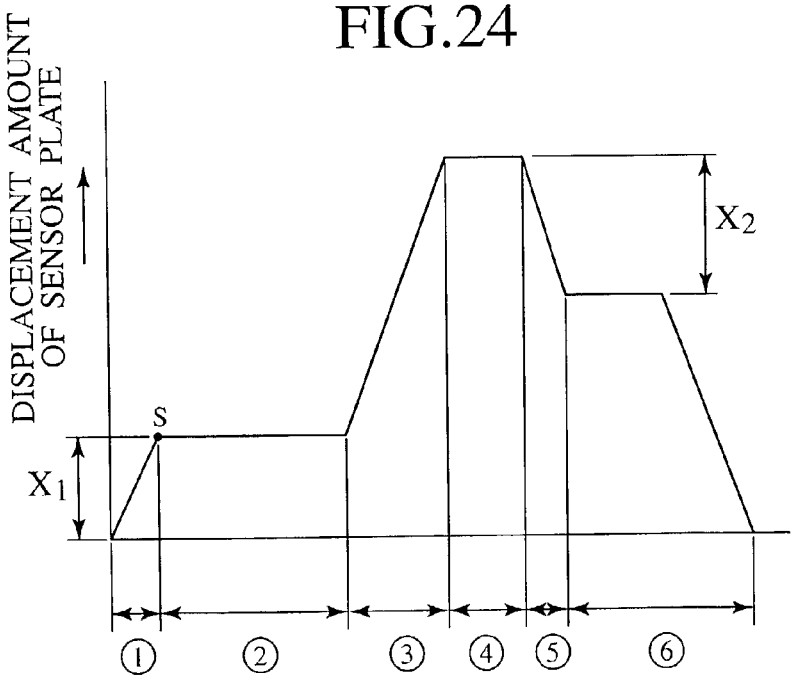
FIG. 24 is a graph showing an amount of displacement of a sensor plate in plate thickness and spring-back amount measurement.

The probe unit 245 is positioned on a bending line of the sample and, at the time of starting bending of the sample, the probe unit 245 is passed through (1) in FIG. 24, and pressed to the sample as described above, and a position t2 of the ram 221 when the photoswitch 257 is turned on at the point S in FIG. 24 is detected. At this point of time, a measured plate thickness of a blank 241 is obtained by a plate thickness arithmetic unit 261 based on an equation, i.e., measured plate thickness=reference plate thickness t1+(t1−t2). Here, (t1−t2) represents an actual plate thickness error with respect to the reference plate thickness. A shown in FIG. 18, the plate thickness arithmetic unit 261 is electrically connected to the CPU 233 of the control unit 207.

Next, description is made of a detection principle of the spring-back amount according to the embodiment.

With the lowering movement of the ram 221, the probe 247 is continuously lowered, and thus bending work is carried out. In this case, a displacement amount of the sensor plate 249 is shifted from (2) to (3) in FIG. 24.

Figure 23A:
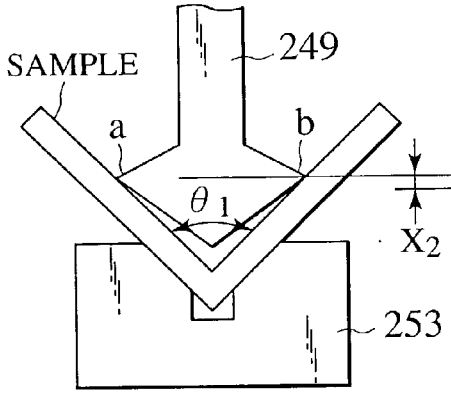
FIGS. 23A and 23B are front views respectively showing a bending state and a spring-back state of the sample materials.

Then, as shown in FIG. 23A, when the sample reaches a position of a targeted bending angle θ1 (θ1=90° in the embodiment) by the probe 247, the displacement amount of the sensor plate 249 is detected by the position sensor 259, and stored in the memory 239. At this time, left and right face angles a and b (a and b in FIG. 21) of the sensor plate 249 are in contact with an inner surface of the bent sample.

Figure 23B:
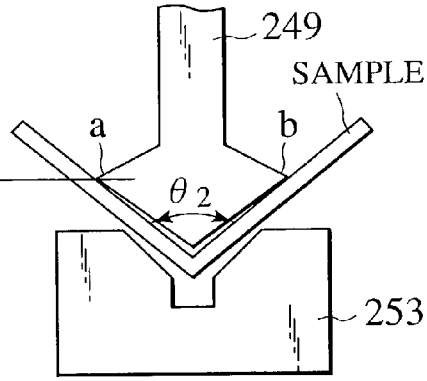

Subsequently, when the ram 221 is raised to also raise the probe 247 in order to remove a bending load, a bending angle θ2 of the sample is widened by spring-back as shown in FIG. 23B. Accordingly, the sensor plate 249 is set in a lowered state as indicated by (5) in FIG. 24. During this period, the left and right angles (a and b in FIG. 23) of the sensor plate 249 are always in contact with the inner surface of the sample.

When the spring-back is finished, and the lowering of the sensor plate 249 is stopped, the displacement amount of the sensor plate 249 is detected by the position sensor 259. Then, a difference in detection values by the position sensor 259 before and after the spring-back is calculated by a spring-back arithmetic unit 263. If this displacement amount is x2, then this value becomes equivalent to the spring-back amount (spring-back equivalent value). As shown in FIG. 18, the spring-back arithmetic unit 263 is electrically connected to the CPU 233 of the control unit 207.

In addition, the probe unit 245 is raised when the detection of the displacement amount x2 is finished as indicated by (6) in FIG. 24.

Next, explanation is now made of the embodiment using the bending machine, for example the press brake 5.

By referring to FIG. 18, since the press bake 5 is publicly known one, schematic explanation is made. The press brake 205 of the embodiment targets a hydraulic down stroking press brake. However, an up stroking press brake or a mechanical press brake using a crank other than the hydraulic type may be used.

The hydraulic down stroking press brake 205 has a punch P loaded and fixed on a lower surface of a movable table freely moved up and down, for example the upper table 265 through a plurality of intermediate plates 267. A die D is loaded and fixed on an upper surface of a fixing table, for example a lower table 269. Accordingly, the work W as a plate material is bent between the punch P and the die D by cooperation thereof.

In FIG. 19, left and right shaft hydraulic cylinders 275 and 277 are installed above left and right side frames 271 and 273 constituting a main body frame. The upper table 267 as a ram is connected to lower ends of piston rods 279 of the left and right shaft hydraulic cylinders 275 and 277. The lower table 269 is fixed on the lower portion of the left and right side frames 271 and 273.

The press brake 205 includes a control unit 209 such as an NC control unit. In the control unit 209, bending condition input means such as an input unit 283 for entering data such as the material of the work W, the plate thickness, a processing shape, a die condition, the target bending angle, and the processing program, a display unit 285 such as a CRT, and a memory 287 for storing such entered data, or the material characteristic data such as the plate thickness or a spring-back amount obtained by the turret punch press 203 are connected to a central processing unit, for example a CPU 281.

A bending program file 289 prepared by fetching the material characteristic data in a control algorithm is also connected to the CPU 281.

A D value arithmetic unit 291 for preparing a ram control value (D value) based on the material characteristic data or other data such as die information is connected to the CPU 281. At this D value arithmetic unit 291, a predetermined angle may not be achieved when bending is carried out by a different punch P and a different die D loaded on the press brake 205 using the spring-back value detected based on the punch P and the die D on the blank processing machine side. Thus, at the press brake 205 side, the D value is subjected to correction when processing is carried out by the punch P and the die D different from those on the blank processing machine.

Next, description is made of a standard process at the sheet metal processing system 201 according to the embodiment.

In the blank processing machine, for example the turret punch press 203, when blank processing is started, first, the work W is positioned in an attachment position of the measuring unit 243. The plate thickness is measured by using the measuring unit 243. In FIG. 19, the plate thickness is measured for each of the samples A and B and the blanks A and B. Instead of measuring the plate thickness for all the samples A and B and the blanks A and B, one the plate thickness of the representative sample or blank may be measured.

Subsequently, an outer periphery of each member, i.e., the samples A and B and the blanks A and B is cut. In this case, each member is joined by microjoints.

At a stage when the cutting is finished, the sample is positioned again to be set directly under the measuring unit 243. In this state, for example bending of 90° is executed, and a spring-back amount $\epsilon$ at this time is measured. Similar operations are performed for both of the samples A and B, and two types of spring-back amounts $\epsilon$ of bending parallel to and perpendicular to a rolling direction of the material are extracted.

The plate thickness and the spring-back amount $\epsilon$ thus measured, and the die condition used for bending are stored in the memory 239 of the control unit 207 in, for example an array similar to that shown in FIG. 25. If a product bending line includes any one of bending lines parallel to and perpendicular to the rolling direction, the spring-back amount $\epsilon$ is measured only for the sample A or B having such a bending line.

Then, at a stage where punching/cutting is finished, the members as products, e.g., the blanks A and B shown in FIG. 19, are separated from the work W, and the process proceeds to bending using the press brake 205. In this bending work, in order to obtain a target angle from first bending, array data similar to that shown in FIG. 25, which has been stored in the memory 239 of the control unit 207 of the turret punch press 203, must be fetched in the bending control algorithm of the press brake 205. In this case, two methods are conceivable for passing the array data to the control unit 209 of the press brake 205.

One is a method of executing direct marking by printing a mark or pasting a bar code label on the blank 241. As a type of marking, a two-dimensional barcode or a QR code which has frequently been used can be used. For marking processing, a general commercial item can be used. For example, an ink jet unit is available in the case of printing, and a label printer or the like is available in the case of label pasting.

In such a case, the mark is linked with the above described array data beforehand and, at the time of starting bending by the press brake 5, a code is read by using, for example a commercially available barcode reader. Accordingly, the linked array data can be extracted. Thereafter, this array data is transmitted from the memory 239 of the control unit 207 of the turret punch press 203, incorporated in the bending control algorithm of the bending program file 289 of the control unit 209 of the press brake 205, and bending control is executed.

Another is a method of using a data communication line. The array data collected by using the measuring unit 243 is stored in the control unit 207 through the communication line and, at the time of starting bending by the press brake 205, the array data is directly fetched in the control unit 209 of the press brake 205 through the communication line. Accordingly, thereafter, the bending control similar to the foregoing is executed.

The blank 241 obtained at the turret punch press 3 is subjected to bending by the press brake 205 in the next step. Thus, at the control unit 207 of the turret punch press 203, as shown in FIG. 18, the data is transmitted to the control unit 209 of the press brake 205.

The present invention is not limited to the described embodiments and, by proper changes, the present invention can be executed in other mode.

In the described embodiments, the detection operation using the measuring unit 243 was described. However, the detection operation can be carried out by combining a well-known bending angle detector and a well-known plate thickness detector.

INDUSTRIAL APPLICABILITY

As can be understood from the foregoing description of the embodiments of the present invention, the actual plate thickness and the actual material constants of each blank can be efficiently and accurately measured during punching in blanking before bending. Thus, this measured information can be reflected on bending, and efficient and accurate bending can be carried out.

The actual plate thickness and the actual material constants of each blank can be measured during punching in blanking before bending. Thus, this measured information can be reflected on bending, and efficient and accurate bending can be carried out. Moreover, for example, a block of blanks having small bending errors simplifies work in the inspection time. Thus, the inspection time after bending can be shortened.

The elongation error of each blank can be measured beforehand. Thus, since bending along an actual situation can be carried out depending on whether the elongation error is within the allowable range or not, it is possible to improve product accuracy and work efficiency during bending, and shorten the inspection time after bending.

Since the actual plate thickness distribution and the actual material constant distribution of a work can be measured during trial-punching before bending, the actual plate thickness and the actual material constants of each blank can be decided. Since this measured information can be reflected on accurate development and blanking of each blank, and also reflected on bending, efficient and accurate bending can be carried out. Moreover, for example since a block of blanks having small bending errors simplifies work in the inspection time, it is possible to shorten the inspection time after bending.

Since the elongation error of each blank can be calculated beforehand, bending along an actual situation can be carried out depending on whether the elongation error is within the allowable range or not. Thus, it is possible to improve product accuracy and work efficiency during bending, and shorten the inspection time after bending.

Since the bending error under control of a stroke amount of each blank can be calculated beforehand, blanking and bending along an actual situation can be carried out depending on whether the bending error is within the allowable range or not. Thus, it is possible to improve product accuracy and work efficiency during bending, and shorten the inspection time after bending.

A bending error under control of a pinching-in angle of each blank can be calculated beforehand. Thus, since blanking and bending along an actual situation can be carried out depending on whether the bending error is within the allowable range or not, it is possible to improve product accuracy, and work efficiency during bending, and shorten the inspection time after bending.

Since the actual plate thickness distribution and the actual material constant distribution of a work can be measured during punching before bending, the actual plate thickness and the actual material constants of each blank can be decided. Since this measured information can be reflected on accurate development and blanking of each blank, and also reflected on bending, efficient and accurate bending can be carried out. Moreover, for example since a block of blanks having small bending errors simplifies work in the inspection time, it is possible to shorten the inspection time after bending.

Since an elongation error of each blank can be calculated beforehand, bending along an actual situation can be carried out depending on whether the elongation error is thin the allowable range or not. Thus, it is possible to improve product accuracy, and work efficiency during bending, and shorten the inspection time after bending.

Since the elongation error of each blank can be calculated beforehand, bending along an actual situation can be carried out depending on whether the elongation error is within the allowable range or not. Thus, it is possible to improve product accuracy and work efficiency during bending, and shorten the inspection time after bending.

Since the bending error under control of the stroke amount of each blank can be calculated beforehand, blanking and bending along the actual situation can be carried out depending on whether the bending error is within the allowable range or not. Thus, it is possible to improve product accuracy and work efficiency during bending, and shorten the inspection time after bending.

Since the bending error under control of the pinching-in angle of each blank can be calculated beforehand, blanking and bending along an actual situation are carried out depending on whether the bending error is within the allowable range or not. Thus, it is possible to improve product accuracy and work efficiency during bending, and shorten the inspection time after bending.

In the blank processing step such as punching or laser cutting before the bending step, at least one of the plate thickness and the spring-back amount of the work is detected as quantitative data of the material characteristic necessary for bending simultaneously with blank processing. Since at least one of the plate thickness and the spring-back amount of the work is incorporated as a control parameter in bending control at a stage of bending using the press brake, it is possible to obtain a bent product having a target angle from first bending without carrying out trial bending.

At the blank processing machine carrying out punching or laser cutting in the step before bending, at least one of the plate thickness and the spring-back amount of the work is detected as quantitative data of a material characteristic necessary for bending simultaneously with blank processing. Thus, since at least one of the plate thickness and the spring-back amount of the work is incorporated as the control parameter in the bending control at a stage of bending using the press brake, it is possible to obtain a product having a target bending angle from first processing without carrying out trial bending.

At the blank processing machine, at least one of the plate thickness and the spring-back amount of the work can be detected as quantitative data of a material characteristic necessary for bending simultaneously with blank processing before bending. Thus, it is possible to use at least one of the plate thickness and the spring-back amount of the work as a control parameter at the stage of bending.

The probe member is lowered to the work set in a predetermined position, and the sensor plate is brought into contact with the work. Then, when the probe member is brought into contact with the work while the sensor plate is in contact with the work, tips of the probe member and the sensor plate coincide with each other. It is possible to easily and accurately calculate the plate thickness of each of the sample and the blank based on a difference between the measured position information detected by position detecting means at this time and the reference position information detected by the position detecting means when the tips of the probe and the sensor plate coincide with each other in previous measurement of a known reference plate thickness.

It is possible to easily and accurately calculate the spring-back amount of the sample based on a difference between the bending position information detected by the position detecting means when the probe member is lowered by a predetermined stroke to bend the sample and the spring-back position information detected by the position detecting means when the probe member is separated form the sample, and the sample is sprung back.

At the work plate thickness measuring device, the probe member is lowered to the work set in a predetermined position, and the sensor plate is brought into contact with the work. Then, when the probe member is brought into contact with the work while the sensor plate is in contact with the work, tips of the probe member and the sensor plate coincide with each other. It is possible to easily and accurately calculate the plate thickness of each of the sample and the blank based on the measuring position information detected by the position detecting means at this time and the reference position information detected by the position detecting means when the tips of the probe and the sensor plate coincide with each other in previous measurement of a known reference plate thickness.

At the spring-back measuring device, it is possible to easily and accurately calculate the spring-back amount of the sample based on a difference between the bending position information detected by the position detecting means when the probe member is lowered by a predetermined stroke to bend the sample and the spring-back position information detected by the position detecting means when the probe member is separated from the sample and the sample is sprung back.

The invention claimed is:

1. A method for processing a plate material, the method comprising:

punching a work into a plurality of blanks, based on a nominal plate thickness and a nominal material constant of the work, while detecting a ram stroke and a pressure at each punching of the work into blanks;

calculating an actual plate-thickness distribution and an actual material-constant distribution of the work, based on data of the ram strokes and the pressures detected in the punching of the work into blanks; and determining an actual plate thickness and an actual material constant of each blank based on the actual plate-thickness distribution and the actual material-constant distribution of the work.

2. The method according to claim 1, further comprising:

bending each blank, based on the determined actual plate thicknesses and actual material constants.

3. The method according to claim 2, wherein, in the bending of each blank, an elongation value of the blank is calculated based on the determined actual plate thickness and the actual material constant of the blank being bent, wherein a determination is made as to whether a difference between the calculated elongation value and a nominal elongation value, obtained based on a nominal plate thickness and a nominal material constant of the work, is within an allowable range, wherein, when the difference is within the allowable range, the bending is based on the actual plate thickness and the actual material constant, and wherein, when the difference is outside the allowable range, the bending is stopped or a significant part is subjected to bending based on the actual plate thickness and the actual material constant.

4. The method according to claim 2, wherein the bending of each blank comprises calculating an average stroke amount for an average blank, having an average plate thickness and average material constant, that is bent by a predetermined angle, wherein a determination is made as to whether a bend angle is within an allowable range of the predetermined angle when another blank is bent by the calculated stroke amount, wherein, when the bend angle is within the allowable range, the blank is subjected to bending by the calculated stroke amount, and wherein, when the bend angle is outside the allowable range, the bending is stopped or the blank is subjected to bending by another stroke amount calculated based on the actual plate thickness and the actual material constant.

5. A method for processing a plate material according to claim 2, wherein the bending of each blank comprises calculating an average pinching-in angle for an average blank having an average plate thickness and average material constant by obtaining a spring-back amount for the average blank, wherein a determination is made as to whether a finishing angle is within an allowable range when another blank is bent by the calculated pinching-in angle, wherein, when the finishing angle is within the allowable range, the blank is subjected to bending by the calculated pinching-in angle, wherein, when the finishing angle is outside the allowable range, the obtained spring-back amount is utilized to calculate another pinching-in angle based on the actual plate thickness and the actual material constant, and bending is carried out using the other calculated pinching-in angle.

6. A method for processing a plate material prior to punching a work into a plurality of blanks, the method comprising:

trial-punching in gaps between adjoining blanks, based on a nominal plate thickness and a nominal material constant of the work, while detecting a ram stroke and a pressure at each trial-punching in the gaps;

calculating an actual plate-thickness distribution and an actual material-constant distribution of the work, based on data of the ram strokes and the pressures detected in the trial-punching;

determining an actual plate thickness and an actual material constant of each blank based on the actual plate-thickness distribution and the actual material-constant distribution of the work;

blanking each blank by punching the work into the plurality of blanks, based on the determined actual plate thicknesses and actual material constants; and bending each blank, based on the determined actual plate thicknesses and actual material constants.

7. The method according to claim 6, wherein, in the blanking of each blank, an elongation value of the blank is calculated based on the determined actual plate thickness and actual material constant of the blank being blanked, wherein a determination is made as to whether a difference between the calculated elongation value and an average elongation value, based upon an average blank having an average plate thickness and average material constant, is within an allowable range, wherein, when the difference is within the allowable range, the blank is subjected to blanking based on the average plate thickness and the average material constant, and wherein, when the difference is outside the allowable range, the blanking is stopped or the blank is subjected to blanking based on the actual plate thickness and the actual material constant.

8. The method according to claim 6, wherein the bending of each blank comprises calculating an average stroke amount for an average blank, having an average plate thickness and average material constant, that is bent by a predetermined angle, wherein a determination is made as to whether a bend angle is within an allowable range of the predetermined angle when another blank is bent by the calculated stroke amount, wherein, when the bend angle is within the allowable range, the blank is subjected to bending by the calculated stroke amount, and wherein, when the bend angle is outside the allowable range, the bending is stopped or the blank is subjected to bending by another stroke amount calculated based on the actual plate thickness and the actual material constant.

9. The method according to claim 6, wherein the bending of each blank comprises calculating an average pinching-in angle for an average blank, having an average plate thickness and average material constant, by obtaining a spring-back amount for the average blank, wherein a determination is made as to whether a finishing angle is within an allowable range when another blank is bent by the calculated pinching-in angle, wherein, when the finishing angle is within the allowable range, the blank is subjected to bending by the calculated pinching-in angle, and wherein, when the finishing angle is outside the allowable range, the obtained spring-back amount is utilized to calculate another pinching-in angle based on the actual plate thickness and the actual material constant of the blank being bent, and bending is carried out using the other calculated pinching-in angle.

10. A system for processing a plate material, comprising:

an automatic programming machine that calculates an expanded dimension of a blank, based on a nominal plate thickness and a nominal material constant of a work to be processed;

a punching machine that punches the work into a plurality of blanks by cooperation of a punch with a die while detecting a ram stroke and a pressure at each punching of the work into blanks;

a control unit including a plate thickness/material constant arithmetic unit that calculates an actual plate-thickness distribution and an actual material-constant distribution of the work based on data of the ram strokes and the pressures detected in the punching of the work into blanks, and that determines an actual plate thickness and an actual material constant of each blank based on the actual plate-thickness distribution and the actual material-constant distribution of the work, and a bending machine that bends each blank, based on the determined actual plate thickness and the actual material constant of the blank being bent.

11. The system for processing a plate material according to claim 10, wherein the control unit includes an elongation error determiner that determines whether a difference between an elongation value of each blank, calculated based on the determined actual plate thickness and the actual material constant of the blank being bent, and a nominal elongation value, obtained based on a nominal plate thickness and nominal material constant of the work, is within an allowable range.

12. The system for processing a plate material according to claim 10, wherein the control unit includes an elongation error determiner that determines whether a difference between an elongation value of each blank, calculated based on the determined actual plate thickness and the actual material constant of the blank being bent, and an average elongation value, based upon an average blank having an average plate thickness and average material constant, is within an allowable range.

13. The system for processing a plate material according to claim 10, wherein the control unit includes a stroke control bending error calculator that calculates an average stroke amount for an average blank having an average plate thickness and average material constant, and that determines whether a bend angle is within an allowable range of a predetermined angle when another blank is bent by the calculated stroke amount.

14. A system for processing a plate material according to claim 10, wherein the control unit includes a pinching-in angle control bending error determiner that calculates a pinching-in angle by obtaining an average spring-back amount for an average blank having an average plate thickness and average material constant, and that determines whether a finishing angle is within an allowable range when another blank is bent by the calculated pinching-in angle.

* * * * *

UNITED STATES PATENT AND TRADEMARK OFFICE

CERTIFICATE OF CORRECTION

PATENT NO. : 7,040,129 B2
APPLICATION NO. : 10/169743
DATED : May 9, 2006
INVENTOR(S) : Junichi Koyama et al.

It is certified that error appears in the above-identified patent and that said Letters Patent is hereby corrected as shown below:

On the Title page, at Item (30), Foreign Application Priority Data, line 2, "Aug. 12, 2000" should be --Dec. 8, 2000--.

On the Title page, at Item (75), Inventors, lines 4 and 5, delete "Tokuro Takehara, Kanagawa (JP);
Tetsuya Anzai, Kanagawa (JP)."

Signed and Sealed this

Eighteenth Day of December, 2007

JON W. DUDAS
*Director of the United States Patent and Trademark Office*